US012564256B2

(12) United States Patent
Gorelick et al.

(10) Patent No.: US 12,564,256 B2
(45) Date of Patent: Mar. 3, 2026

(54) MOTORIZED TOENAIL GROOMER CONFIGURED TO SIT ON TOP OF A FOOT WITH LONG SHAFT AND HANDLE PERMITTING EASE OF USE BY ELDERLY AND/OR INFLEXIBLE USERS

(71) Applicant: Pedicure, Inc., Ithaca, NY (US)

(72) Inventors: Jordan Gorelick, Woodbridge, CT (US); Joshua Zhu, Brooklyn, NY (US); Stacey Wong, New Hyde Park, NY (US); Jialin Ke, Brooklyn, NY (US); Jonathan Pao, Boston, MA (US); Mary Feyrer, Hanover, NH (US); Felix Shi, Ithaca, NY (US); Daryn Golub, Sleepy Hollow, NY (US); Dhaval Thakkar, Schaumburg, IL (US); Ivan Josue de Leon Avila, Merida (MX)

(73) Assignee: Pedicure, Inc., Ithaca, NY (US)

( * ) Notice: Subject to any disclaimer, the term of this patent is extended or adjusted under 35 U.S.C. 154(b) by 566 days.

(21) Appl. No.: 17/847,497

(22) Filed: Jun. 23, 2022

(65) Prior Publication Data

US 2022/0395070 A1 Dec. 15, 2022

Related U.S. Application Data

(63) Continuation-in-part of application No. 16/860,298, filed on Apr. 28, 2020, now Pat. No. 11,612,229.

(Continued)

(51) Int. Cl.
*A45D 29/05* (2006.01)

(52) U.S. Cl.
CPC ..... *A45D 29/05* (2013.01)

(58) Field of Classification Search
CPC ..... A45D 29/00; A45D 29/04; A45D 29/05; A45D 29/11; A45D 29/12; A45D 29/14; A45D 2029/026; A45D 2029/045
See application file for complete search history.

(56) References Cited

U.S. PATENT DOCUMENTS 527,240 A 10/1894 Garies
857,790 A 6/1907 Carroll
(Continued)

FOREIGN PATENT DOCUMENTS

CA 670052 9/1963
DE 2752179 6/1979
(Continued)

OTHER PUBLICATIONS

Press Fit Forces Stress Design Calculator, Jun. 18, 2018, available at: www.engineersedge.com/calculators/machine-design/press-fit/press-fit.htm.

(Continued)

*Primary Examiner* — Rachel R Steitz
*Assistant Examiner* — Karim Asqiriba
(74) *Attorney, Agent, or Firm* — Thomas A. O'Rourke; James Bongiorno; O'Rourke IP Law, PLLC

(57) ABSTRACT

A nail groomer to aid elderly and flexibility-challenged individuals, is convertible between: a first configuration adapted for filing toenails, and a second configuration adapted for filing fingernails. The nail groomer includes: a grooming head, shaft, and handle configured to be grasped by a user's hand to manipulate the nail groomer. The grooming head has a housing, a motor, and a filing bit with an abrasive surface. The motor rotates the filing bit, so the abrasive surface can abrade portions of a nail. A housing opening releasably receives one end of the shaft, to form the first configuration, and a particular shaft length permits (Continued)

positioning the filing bit at a user's toenails when the handle is grasped and manipulated by the user. With the shaft detached from the grooming head, the user grasps and manipulates the grooming head's housing directly with one hand, for filing of fingernails of the other hand.

17 Claims, 35 Drawing Sheets

Related U.S. Application Data

(60) Provisional application No. 63/228,695, filed on Aug. 3, 2021, provisional application No. 62/840,818, filed on Apr. 30, 2019.

(56) References Cited

U.S. PATENT DOCUMENTS

| | | | | |
|---|---|---|---|---|
| 1,556,510 | A | 10/1925 | King | |
| 1,892,867 | A | 1/1933 | Burr | |
| 2,532,370 | A | 12/1950 | Perrill | |
| 2,880,737 | A | 4/1959 | Tone | |
| 3,216,034 | A | 11/1965 | Johnson | |
| 3,596,667 | A | 8/1971 | Buercklin | |
| 3,613,696 | A | 10/1971 | Paule | |
| 4,103,694 | A | 8/1978 | Burian | |
| 4,207,880 | A | 6/1980 | Zinkovich | |
| 4,294,268 | A | 10/1981 | Kitrell | |
| 4,328,819 | A | 5/1982 | Haas | |
| 4,408,623 | A | 10/1983 | Murray | |
| 4,683,897 | A | 8/1987 | McBride | |
| 4,753,253 | A | 6/1988 | Hutson | |
| 4,847,994 | A | 7/1989 | Dunn | |
| 4,854,334 | A | 8/1989 | Su | |
| 4,893,406 | A | 1/1990 | Larson | |
| 4,956,915 | A | 9/1990 | Anderson | |
| 5,123,430 | A | 6/1992 | Davidovitz | |
| 5,357,677 | A | 10/1994 | West | |
| 5,546,658 | A | 8/1996 | MacLeod | |
| 5,564,969 | A * | 10/1996 | Tsang | B25F 5/02 451/344 |
| 5,749,377 | A | 5/1998 | Desario | |
| 5,775,340 | A * | 7/1998 | Rains | A61B 17/54 30/28 |
| 5,864,746 | A | 1/1999 | Chang | |
| 5,931,167 | A | 8/1999 | Coleman | |
| 6,050,270 | A | 4/2000 | Tyshenko | |
| 6,220,251 | B1 | 4/2001 | Jeong | |
| 6,325,069 | B1 | 12/2001 | Heims | |
| 6,539,632 | B2 | 4/2003 | Anctil | |
| 6,601,587 | B2 | 8/2003 | Shaw | |
| 6,799,579 | B2 | 10/2004 | Joseph | |
| 6,865,812 | B1 | 3/2005 | Martin | |
| 7,188,628 | B2 | 3/2007 | Shubert | |
| 7,954,242 | B1 | 6/2011 | Brizan | |
| 8,201,565 | B2 | 6/2012 | Fernandez | |
| 8,356,414 | B2 | 1/2013 | Wendorf | |
| 8,472,129 | B1 | 6/2013 | Trask | |
| 8,667,691 | B2 * | 3/2014 | Gibbs | A45D 29/02 30/28 |
| 9,486,051 | B1 | 11/2016 | Robinson | |
| 9,833,053 | B1 * | 12/2017 | Williams | A61B 17/54 |
| D852,421 | S | 6/2019 | Solitt | |
| 10,660,484 | B1 * | 5/2020 | Okuszka | A47K 7/04 |
| 2002/0092170 | A1 | 7/2002 | Anctil | |
| 2002/0134395 | A1 | 9/2002 | Hermiz | |
| 2003/0094183 | A1 * | 5/2003 | Shaw | A45D 29/18 132/75.3 |
| 2004/0045568 | A1 | 3/2004 | Abbott | |
| 2005/0103356 | A1 | 5/2005 | Edman | |
| 2008/0066771 | A1 | 3/2008 | Pinchuk | |
| 2008/0296447 | A1 | 12/2008 | Peterson | |
| 2009/0119922 | A1 | 5/2009 | Doyle | |
| 2009/0223055 | A1 | 9/2009 | Wendorf | |
| 2009/0229622 | A1 | 9/2009 | Malin | |
| 2010/0000557 | A1 * | 1/2010 | Keene | A45D 29/14 362/253 |
| 2011/0226268 | A1 * | 9/2011 | Filonczuk | A45D 29/14 132/73.6 |
| 2011/0226270 | A1 | 9/2011 | Rivera | |
| 2013/0000125 | A1 * | 1/2013 | Gibbs | A45D 29/02 30/28 |
| 2014/0096796 | A1 * | 4/2014 | Frum | B08B 1/32 15/97.1 |
| 2015/0150353 | A1 * | 6/2015 | Yiu | A61B 17/54 132/75.6 |
| 2015/0173484 | A1 * | 6/2015 | Fitzsimons | A45D 29/05 132/200 |
| 2016/0270505 | A1 | 9/2016 | Downey | |
| 2018/0000221 | A1 | 1/2018 | Adem | |
| 2018/0199689 | A1 | 7/2018 | Carton | |
| 2019/0090608 | A1 | 3/2019 | McMullen | |
| 2019/0152042 | A1 * | 5/2019 | Kemp | A61H 7/003 |
| 2020/0154847 | A1 * | 5/2020 | Fields | A45D 29/02 |
| 2021/0321741 | A1 | 10/2021 | Schulz | |
| 2024/0306794 | A1 * | 9/2024 | Henshall | A45D 29/02 |

FOREIGN PATENT DOCUMENTS

| | | | |
|---|---|---|---|
| DE | 10038445 | | 2/2002 |
| EP | 1607019 | | 12/2001 |
| EP | 1716799 | | 5/2010 |
| FR | 2635447 | | 2/1990 |
| GB | 2191396 | A | 12/1987 |
| GB | 2375044 | A | 11/2002 |
| GB | 2427136 | A | 12/2006 |
| WO | WO 91/19436 | | 12/1991 |
| WO | WO 2008/028020 | | 3/2008 |

OTHER PUBLICATIONS

"Three General Types of Fit," available at www.mmto.org/dclark/Reports/Encoder%20Upgrade/fittolerences%20%5BRead-Only%5D.pdf., Jul. 8, 2019.

"Engineering Fit," available at: https://en.wikipedia.org/wiki/Engineering_fit, Jul. 8, 2019.

"Foot Shape Ancestry: What Your Toes Can Tell You," Nov. 15, 2018, avalable at: https://blog.genealogybank.com/foot-shape-ancestry-what-your-toes-can-tell-you.html.

ClipDifferent, Automatic Fingernail Clippers, ClipDifferent Pro $149, May 16, 2020, available at: https://clipdifferent.com/product/professional-automatic-fingernail-clipper/.

* cited by examiner

FIG. 4
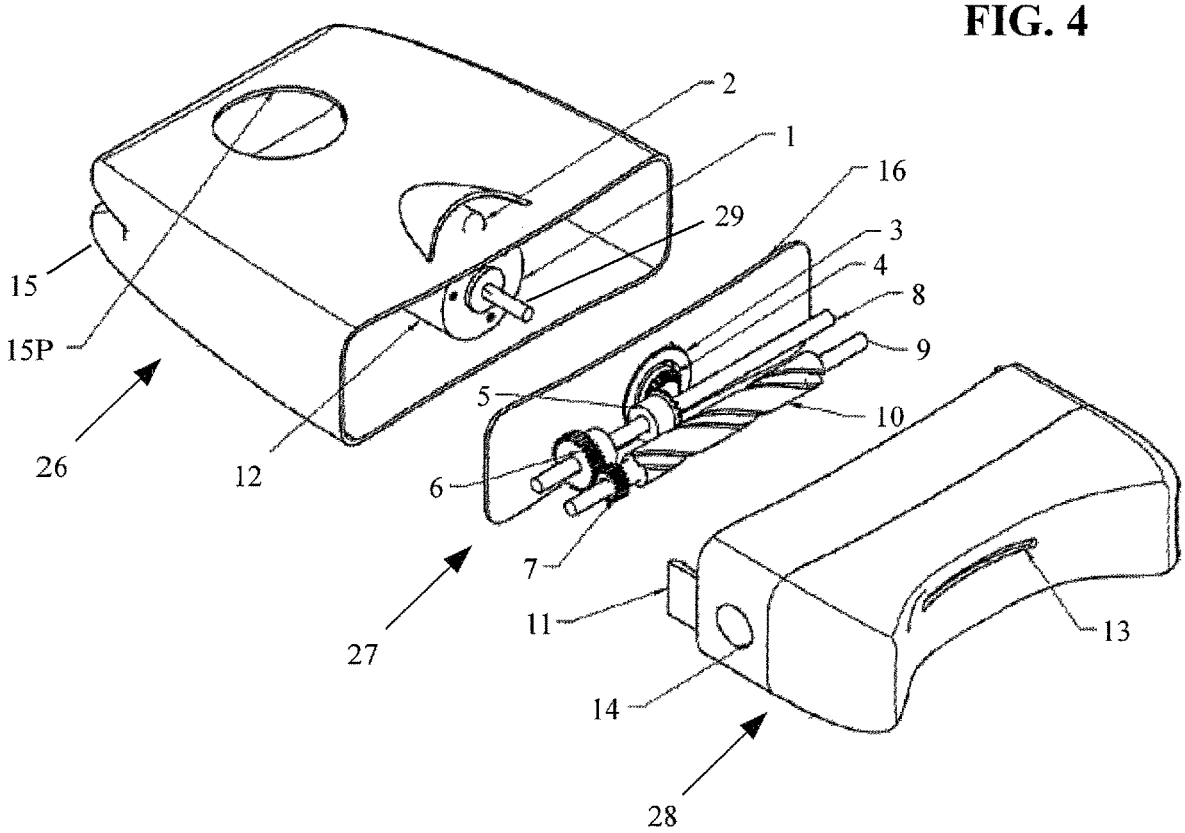
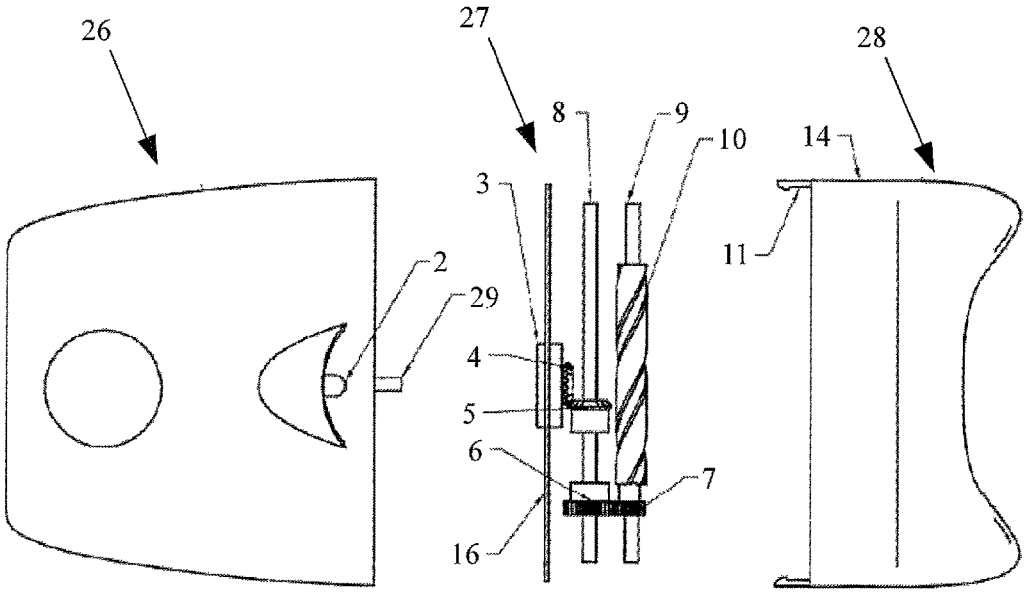
FIG. 5

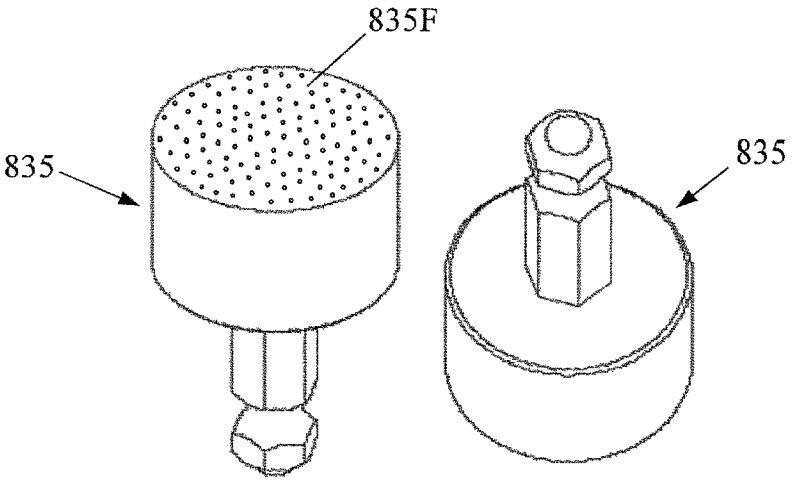
FIG. 33
FIG. 32
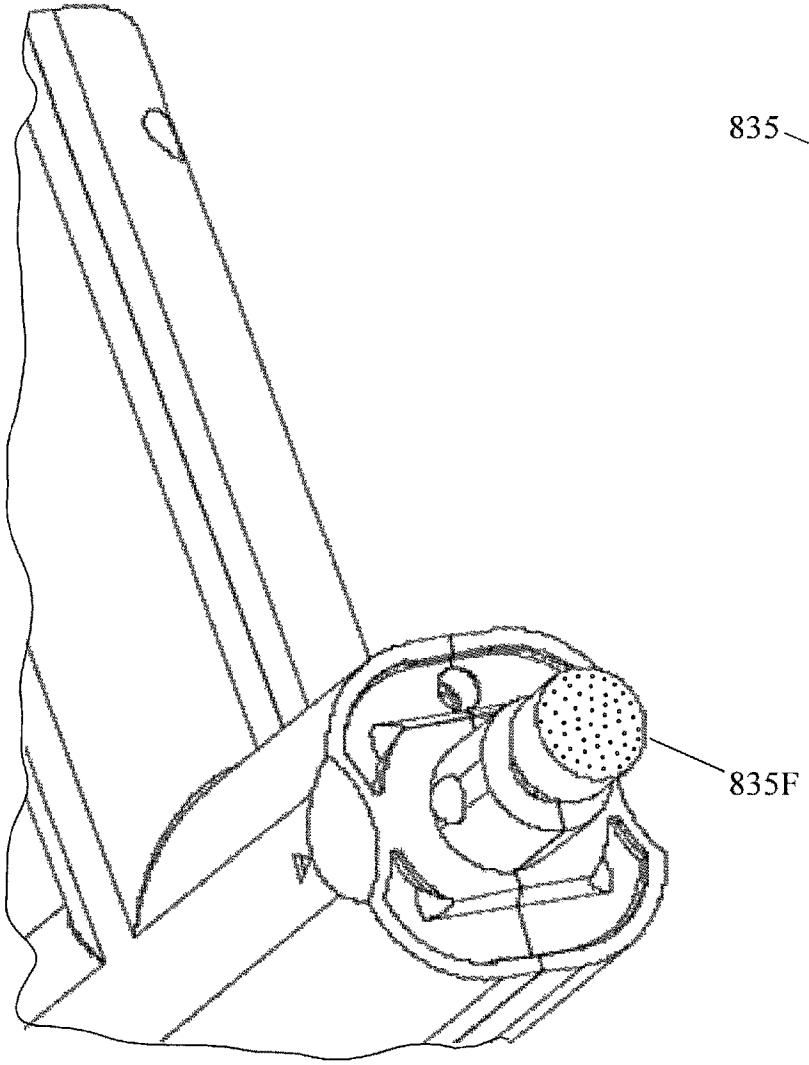
FIG. 31

MOTORIZED TOENAIL GROOMER CONFIGURED TO SIT ON TOP OF A FOOT WITH LONG SHAFT AND HANDLE PERMITTING EASE OF USE BY ELDERLY AND/OR INFLEXIBLE USERS

CROSS REFERENCES TO RELATED APPLICATIONS

This application claims priority on U.S. Provisional Patent Application Ser. No. 63/228,695, filed on Aug. 3, 2021, and is also a continuation in part of U.S. patent application Ser. No. 16/860,298, filed on Apr. 28, 2020, which claims priority on U.S. Provisional Application Ser. No. 62/840,818, filed on Apr. 30, 2019, all disclosures of which are incorporated herein by reference.

BACKGROUND OF INVENTION

1. Field of Invention

The present invention relates to nail grooming for the elderly and other flexibility challenged persons (e.g., pregnant women) and/or physically disabled individuals (e.g., a paraplegic) who would otherwise experience difficulty in utilizing traditional toenail trimmers, and more particularly to a long-handled nail groomer with motorized nail grooming bit in a detachable head also being thereby usable for grooming fingernails.

2. Description of the Prior Art

A traditional nail clipper is designed for convenience of clipping fingernails but may be difficult to use to clip toenails for an elderly person, even for the larger sized nail clippers intended for use on a person's toenails. When clipping toenails, the user usually has to manipulate his or her body into various positions such as bending over one's legs by pivoting at the hips, retracting one's legs by bending at the knee, or lifting the foot/leg to rest on a table or chair. These positions are very uncomfortable or may be impossible for those who are elderly, disabled, ill, obese or pregnant. These users risk injury when attempting to cut their toenails because of poor body positioning, which users may therefore be forced to rely on help from family, friends, and other caregivers. Conventional toenail trimming is also challenging for people with diabetes, and people with foot neuropathy who are in danger of cutting themselves with a traditional toenail clipper since they have no sensation in the foot. Other challenges for toenail trimming are presented by: 1) obesity; 2) arthritis (because the user can't hold traditional clippers); 3) hip surgery or hip precautions (the user can't bend past 90 degrees); 4) knee surgery; 5) back pain or back surgery; 6) lung disease (COPD) because they can't breathe when they bend down; and/or 7) short arms, inflexible.

Also, toenail trimming is conventionally performed with small handheld clippers which require exertion of physical force to cut through toenail keratin. This aspect of the traditional method of toenail clipping serves as an additional obstacle for the elderly, and the handicapped, who may lack the required physical strength. Further exacerbating these problems are the limited vision, and decreased fine motor skills to accurately position the trimmer. The factors may contribute to an increased prevalence of foot fungus, nail deformation, and ingrown toenails among individuals whom are unable to address their difficulties and maintain proper toenail care.

A number of nail clipper devices have been disclosed. An example of such a device is the Electrically Automated Nail-Clipping Device, issued as U.S. Pat. No. 4,328,819, in the name of Everett L. Haas (Haas patent). The Haas patent utilizes a vibrating blade which severs nails as the blade moves back and forth. The Haas nail trimmer and other similar nail trimmers seek to address the physical limitations of individuals with deficient strength and limited fine motor skills. However, although the abrasive grit in these devices are susceptible to being worn down with time, no method is disclosed to extract and replace the grit from the internal portions of the device. Additionally, these devices provide little support for elderly users that have problems with maneuverability and flexibility.

Some toenail trimmers have further included an extension arm in their designs to offer a method to reach the lower extremities of the elderly user in the face of limited flexibility and maneuverability. An example of such a device is the Nail Trimmer, issued as U.S. Pat. No. 6,865,812, in the name of Roy C. Martin, Jr. (Martin patent). While the Martin patent, and similar devices, address the mobility issue with the extension arm, the utilization of the feature remains quite rudimentary and offers no real support for the device with respect to the arm of the user, apart from merely being grasped by a single hand, which requires an undue amount of hand strength and dexterity to both hold and manipulate the device.

There is a long felt but unmet need in the art of toenail trimmers for apparatus that provides greater assistance for individuals with physical deficiencies, particularly with respect to providing support for the users hand and/or arm during the process, which may eliminate ineffective nail trimming and eliminate the cuts and bruises that may result from such ineffective nail trimming. There is also a long felt but unmet need in the art of toenail trimmers for apparatus that permits toenails to be trimmed in a safe and easy manner, while permitting the individual to assume a comfortable position throughout the toenail trimming process.

The apparatus disclosed herein addresses the deficiencies with respect to prior art toenail trimmers.

OBJECTS OF THE INVENTION

It is an object of the invention to provide a device that may be used to assist a person that has reduced arm strength and/or dexterity to more easily trim his/her toenails.

It is another object of the invention to provide a device that may be used by the elderly and flexibility challenged individuals to trim his/her toenails without having to bend excessively to reach the toenails.

It is an object of the invention to provide a device that may be used by the elderly and flexibility challenged individuals to more safely trim his/her toenails.

It is another object of the invention to provide a toenail trimmer device that may be used by the elderly and flexibility challenged individuals to trim his/her toenails, without the use of clippers or shears that may inadvertently cause damage to the sides of the user's toes.

It is a further object of the invention to provide a toenail trimming apparatus that may provide enhanced support with respect to a user's arm for trimming of his/her toenails.

It is another object of the invention to provide a toenail trimming apparatus that may have two points of support with respect to the user's arm while trimming of his/her toenails.

It is also an object of the invention to provide a toenail trimming apparatus that may have a long handle, a portion of which may be particularly configured to be ergonomically grasped by the user's hand, while a distal end of the handle may be particularly configured to releasably couple to the user's forearm or upper arm, to assist in holding, supporting, and guiding the trimmer into contact with the user's toenails.

It is another object of the invention to provide a base that may be used to support a user's foot, while a toenail trimming device is used to trim his/her toenails.

It is also an object of the invention to provide a base that may be used to support a user's foot, and which may co-act with a particularly configured long-handled toenail trimming device, to assist elderly and flexibility-challenged individuals to more easily trim his/her toenails.

It is another object of the invention to provide improved, quick-release interchangeable trimmer head caps, each formed with a ribbed periphery for easier grasping by an elderly user, and each with a different sized opening to accommodate a variety of different sized toes, toenails and fingernails of the user;

It is a further object of the invention to provide a motorized nail trimmer that provides a simplified/easy trimming experience for both fingernails and toenails.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A first embodiment of a toenail trimming apparatus disclosed herein includes a long handled trimmer and a particularly configured base that the long handle trimmer may cooperate with for the user to more easily trim his or her toenails.

The long handled trimmer may include an extension arm, which may telescope or disassemble in sections, a motorized nail trimmer attached proximate to one end of the arm, an arm cuff attached proximate to the other end of the arm, and a handle extending laterally away from the arm between the two ends. The combination of the cuff and the handle provide greater ease in maneuvering of the device by an elderly user who may have diminished motor skills/dexterity.

In one embodiment, the motorized trimmer may use a rotating shaft upon which is formed a trimmer surface that is striated and designed to shave the toenail and not cut the skin.

In another embodiment, the motorized trimmer may use a rotating flexible sanding belt, with an amount of grit to allow for shaving of the toenail. The attached motorized nail trimmer may have a unique shape for the housing on the trimming end that simultaneously enables separation of two toes that allows for trimming of one toe without adjacent toes getting in the way.

The base acts not only as a footrest, but also as a means for assisting in maneuvering of the long handled trimmer, as it may include a curved slot that serves as a track that receives and guides a lower end of the long handled trimmer.

The base being so configured to cooperate with the long handled trimmer may also serve to support the weight of the trimmer, and alleviate the need for the elderly user's arm to have to support it during use, even where the device may be considered lightweight with respect to an arm of a younger/stronger user (e.g., a pregnant woman).

The base may also serve in stabilizing and securing the long handled trimmer during the trimming process. The base may be adjustable to different heights and angles to accommodate a variety of seating positions, and may include a light and magnifier This apparatus allows for disassembly and reassembly of its components which provides convenience for storing as well as making it easier for users to reach and set up the apparatus.

Another embodiment of a toenail trimming apparatus disclosed herein may only include a particularly formed long handled trimmer with a cuff and handle, which is intended to be used without the base.

A third embodiment of the toenail trimming apparatus disclosed herein may only include the toenail trimmer itself, used independently of the long handle shaft and foot support base.

Another embodiment provides an improved shroud that is reduced in size and formed with a ribbed periphery for easier grasping by an elderly user, and better accommodates removal and reattachment for replacement with one having a different sized opening to accommodate a variety of different sized toes, toenails and fingernails of the user.

BRIEF DESCRIPTION OF THE DRAWINGS

The description of the various example embodiments is explained in conjunction with appended drawings, in which:

FIG. 4 is an exploded perspective view of the component parts of the motorized nail trimmer of the long handled nail trimmer device shown in FIG. 1.

FIG. 5 is a top view of the component parts shown in FIG. 4.

FIG. 31 is a perspective view of the grooming head of FIG. 23, shown with the filing cap removed to expose the filing bit mounted to the rotary shaft of the motor.

FIG. 32 is a first perspective view of the disk-shaped filing bit of FIG. 31.

FIG. 33 is a second perspective view of the disk-shaped filing bit of FIG. 31.

DETAILED DESCRIPTION OF THE INVENTION

Figure 1:
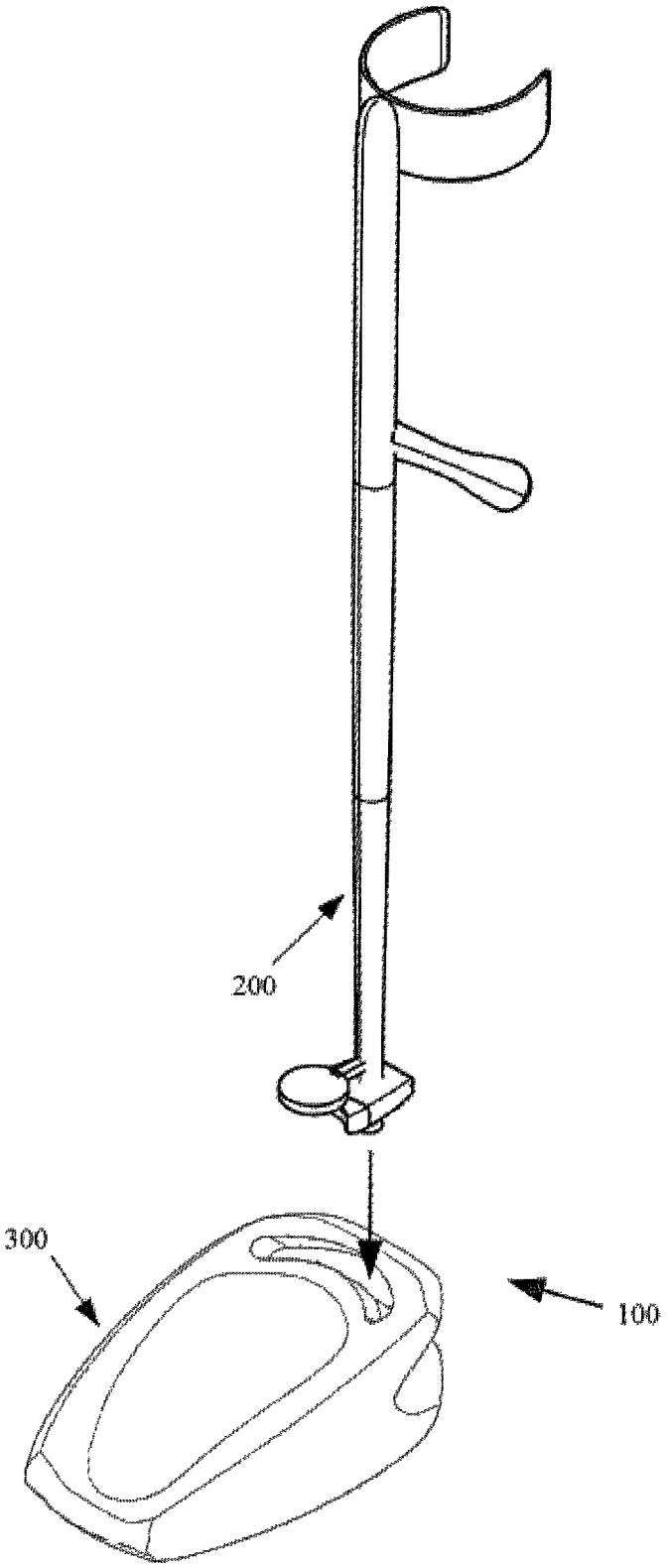
FIG. 1 is a perspective view of a first embodiment of a long-handled toenail trimmer configured to cooperate with the foot support base also shown therein.

As used throughout this specification, the word "may" is used in a permissive sense (i.e., meaning having the potential to), rather than a mandatory sense (i.e., meaning must), as more than one embodiment of the invention may be disclosed herein. Similarly, the words "include", "including", and "includes" mean including but not limited to.

Any reference made throughout this specification to "one embodiment" or "an embodiment" means that a particular feature, structure, or characteristic described in connection therewith is included in at least that one particular embodiment. Thus, the appearances of the phrases "in one embodiment" or "in an embodiment" in various places throughout this specification are not necessarily all referring to the same embodiment. Therefore, the described features, advantages, and characteristics of any particular aspect of an embodiment disclosed herein may be combined in any suitable manner with any of the other embodiments disclosed herein.

The phrases "at least one", "one or more", and "and/or" may be open-ended expressions that are both conjunctive and disjunctive in operation. For example, each of the expressions "at least one of A, B and C", "one or more of A, B, and C", and "A, B, and/or C" herein means all of the following possible combinations: A alone; or B alone; or C alone; or A and B together; or A and C together; or B and C together; or A, B and C together.

Any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of a multiplicity of such individual tolerances.

Any use of a friction fit (i.e., an interface fit) between two mating parts described herein indicates that the opening (e.g., a hole) is smaller than the part received therein (e.g., a shaft), which may be a slight interference in one embodiment in the range of 0.0001 inches to 0.0003 inches, or an interference of 0.0003 inches to 0.0007 inches in another embodiment, or an interference of 0.0007 inches to 0.0010 inches in yet another embodiment, or a combination of such ranges. Other values for the interference may also be used in different configurations (see e.g., "Press Fit Engineering and Design Calculator," available at: www.engineersedge.com/calculators/machine-design/press-fit/press-fit-calculator.htm).

Any described use of a clearance fit indicates that the opening (e.g., a hole) is larger than the part received therein (e.g., a shaft), enabling the two parts to move (e.g. to slide and/or rotate) when assembled, where the gap between the opening and the part may depend upon the size of the part and the type of clearance fit 13 i.e., loose running, free running, easy running, close running, and sliding (e.g., for a 0.1250 inch shaft diameter the opening may be 0.1285 inches for a close running fit, and may be 0.1360 inches for a free running fit; for a 0.5000 inch diameter shaft the opening may be 0.5156 inches for a close running fit and may be 0.5312 inches for a free running fit). Other clearance amounts are used for other clearance types. See "Engineering Fit" at: https://en.wikipedia.org/wiki/Engineering fit; and "Three General Types of Fit," available at www.mmto.org/dclark/Reports/Encoder%20Upgrade/fittolerences%20%5BRead-Only%5D.pdf.

As used herein, the term "hand-held" and "graspable" describes that at least one part of the toenail trimmer is easily and conveniently held and handled by even the average small-sized human hand.

It is further noted that any use herein of relative terms such as "top," "bottom," "upper," "lower," "vertical," and "horizontal" are merely intended to be descriptive for the reader, and may be based on the depiction of those features within the figures for one particular position of the apparatus, and such terms are not intended to limit the orientation with which the disclosed toenail trimmer may be utilized.

Also, the disclosures of all patents, published patent applications, and non-patent literature cited anywhere within this document are incorporated herein in their entirety by reference. However, it is noted that citing herein of any patents, published patent applications, and non-patent literature is not an admission as to any of those references constituting prior art with respect to the disclosed and/or claimed apparatus/method.

FIG. 1 shows a first embodiment of toenail trimming apparatus disclosed herein. The toenail trimming apparatus 100 includes a long handled trimmer 200 and a particularly configured base 300 that the long handle trimmer may cooperate with for the user to more easily and safely trim his or her toenails.

Figure 2:
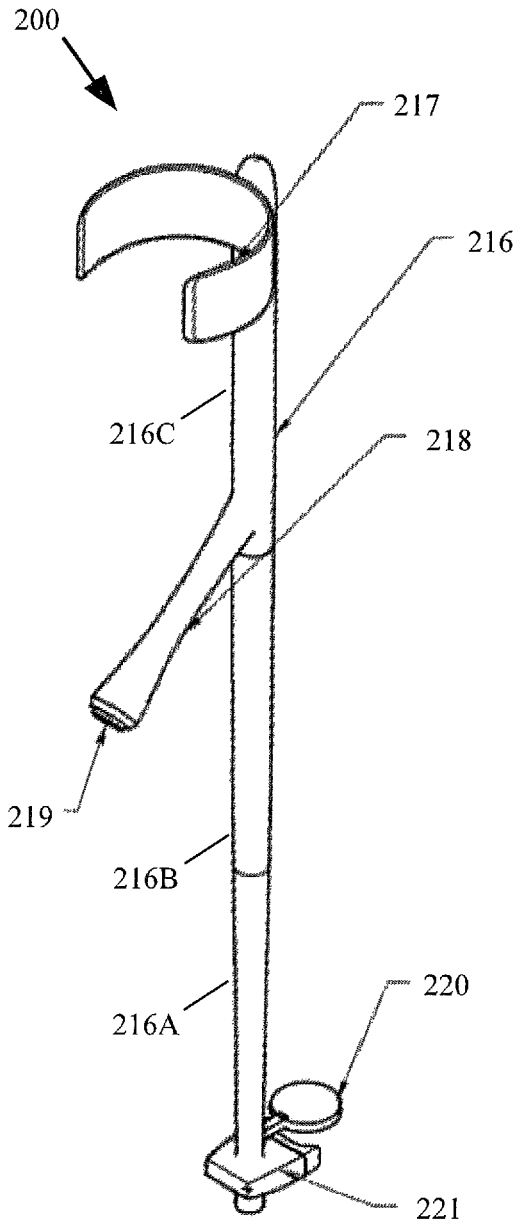
FIG. 2 is a perspective view of the long handled nail trimmer shown in FIG. 1.
Figure 3:
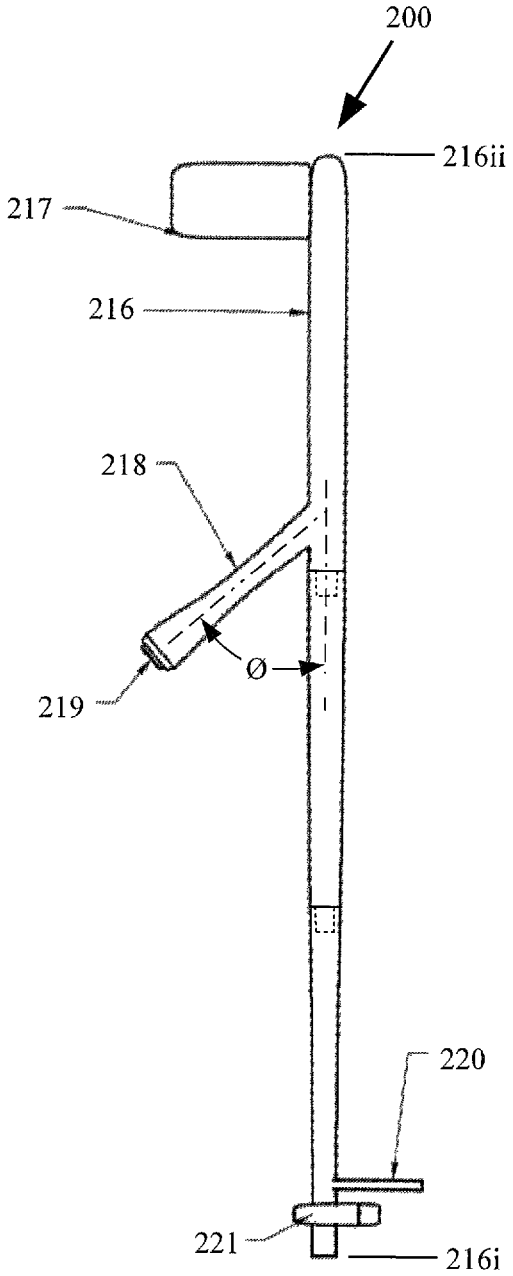
FIG. 3 is a side view of the long handled nail trimmer shown in FIG. 1.

The long handled trimmer 200 is shown in detail in FIGS. 2-3. The long handled trimmer 200 may be formed to include an extension arm 216, a motorized trimmer 221, an arm cuff 217, and a handle 218 with a handle button/switch 219.

The extension arm 216 may extend from a first end **216*i* to a second end 216*ii*, and may taper between those ends. The extension arm 216 may be a solid rigid member or may be hollow, and may be formed of any suitable material, including, but not limited to, wood, plastic, metal, composites, etc. The extension arm 216 may alternatively be formed to be broken down into segments for portability and for easier storage of the device. In one embodiment, the extension arm 216 may be formed of a plurality of hollow sections (e.g., section 216A, section 216B, and section 216C) which allows the sections to be separated to collapse, and subsequently reattach. When separated the sections 216A/216B/216C may be loosely coupled together using elastic to prevent them from scattering after the user has disconnected the sections and seeks to store the device. When assembled for use, each of the sections 216A/216B/216C of extension arm 216 may be releasably coupled together using a press fit between the inner diameter of one section and the outer diameter of the adjacent segment, or using a detent, or any other suitable apparatus to accomplish releasable such coupling that may be known in the art. These interconnected portions may each be cylindrical or may instead be formed to be conical. In another embodiment the extension arm 216** may be formed of a plurality of telescoping sections that may collapse into each other, and may be extended outward and maintained in the extended position using a detent mechanism at each interconnection. Any suitable detent mechanism may be used appropriately herein, including, but not limited to, the detent mechanism shown in U.S. Pat. No. 6,016,594 to Frey.

The motorized trimmer 221 may be positioned proximate to the first end **216*i* of the extension arm 216. As shown in detail within FIG. 4 and FIG. 5, the motorized trimmer 221 may include three portions: a power unit 26, a drive/trimmer unit 27, and a shroud 28**.

The power drive unit 26 may include an AC motor, or alternatively may include a DC motor 1 with a primary motor shaft 29, which motor may be mounted to a housing 15 that may also be configured to house a battery 12 to power the DC motor.

The drive/trimmer unit 27 may include: a bearing 3 that may be mounted to a housing plate 16; a main drive gear 4 with a primary motor shaft 29; a main drive shaft 8; a drive miter gear 5; a drive shaft gear 6; a trimmer gear 7; and a trimmer shaft 9 having a trimmer surface 10.

The shroud 28 may be formed to include a nail trimming slot 13, a quick release tab 11 that engages the housing 15 of the power drive unit 26, and a quick release pad 14 that is connected to the quick release tab 11 and may be actuated (i.e., be depressed) to cause the tab to disengage from the housing 15 when the two parts are to be separated.

The main drive gear 4 is configured to be driven by the primary motor shaft 29 of the DC motor 1. The main drive gear 4 is encased in the bearing 3 which supports the main drive gear while allowing it to spin freely. The drive miter gear 5 is mounted on the main drive shaft 8 and meshes with the main drive gear 4. The drive shaft gear 6 is also mounted on the main drive shaft 8 and meshes with trimmer gear 7 that is mounted to the shaft 9 upon which is formed the trimmer surface 10 that is configured to trim the user's nail. (Note that the ends of each of the main drive shaft 8 and the shaft 9 may be rotatably mounted to flanges protruding from the housing plate 16, which flanges are not shown in FIG. 4).

Therefore, with this mechanical arrangement the DC motor causes rotation of the primary motor shaft 29 and the main drive gear 4, which main drive gear being meshed with the drive miter gear 5 causes rotation of each of the drive miter gear and shaft 8 and drive shaft gear 6, which drive shaft gear 6 being meshed with the trimmer gear 7 causes rotation of shaft 9 and the trimmer surface 10.

The shroud 28 is coupled to the housing 15 so that the wall in which the nail trimming slot 13 is formed may be in close proximity to the trimmer surface 10 (i.e., being separated therefrom by a distance of between 0.005 inches and 0.010 inches in one embodiment, and between 0.010 inches and 0.015 inches in another embodiment, and between 0.015 inches and 0.025 inches in another embodiment, although other distance ranges or a combination of such distance ranges may also be used in other embodiments). The separation distance from the trimmer surface 10 is preferably small enough to permit sufficient trimming of the user's toenail, while being safe in terms of preventing contact of the soft tissue of the person's toes therewith, which is also prevented by the narrow height of the trimming slot 13. Accordingly, the trimmer slot 15 allows the toenail to be trimmed by trimmer surface 10 without touching the skin of the toe. In one embodiment the trimmer surface may include one or more flutes with sharp edges to abrade the toenail. In another embodiment the trimmer surface 10 may be an abrasive surface and the shaft 9 may be similar to a grinder wheel. In yet another embodiment, the trimmer surface 10 of the motorized trimmer 221 will not cut skin because it is not sharp and abrasive; rather, the trimmer surface may have striations which are angled so that they only tend to shave the toenail.

The shroud 28 being configured for quick release and removal from engagement with the housing 15 of the power drive unit 26 permits removal and replacement of component parts of the drive/trimmer unit 27. The housing plate 16 of the drive/trimmer unit 27 may also be configured to be coupled to the power unit 26 via screws or bolts, or by a quick release mechanical means (e.g., a one-quarter turn, quick release fastener—see e.g., U.S. Pat. No. 3,145,441 to Strandrud; U.S. Pat. No. 3,247,753 to Appleberry; etc.).

The trimmer plate 16 also serves to encase the components of drive/trimmer unit 27 so that nail filings will remain contained and collected between the plate and the shroud 28 and be prevented from entering the power unit 26. The quick release feature for mounting of the shroud 28 also allows for its cleaning/sterilization between users.

The motorized trimmer 221 may be secured to the extension arm 216 in any suitable manner, including, but not limited to, be welded thereto, being mechanically fastened thereto, etc. In another embodiment, the housing 15 of the power drive unit 26 may be integrally formed with the bottom of the extension arm 216. In another embodiment that is shown in the figures the housing 15 of the power drive unit 26 may be formed with an orifice 15P (see FIGS. 4-5) that may be configured to receive a portion of the bottom of the section 216A of the extension arm.

Figure 8:
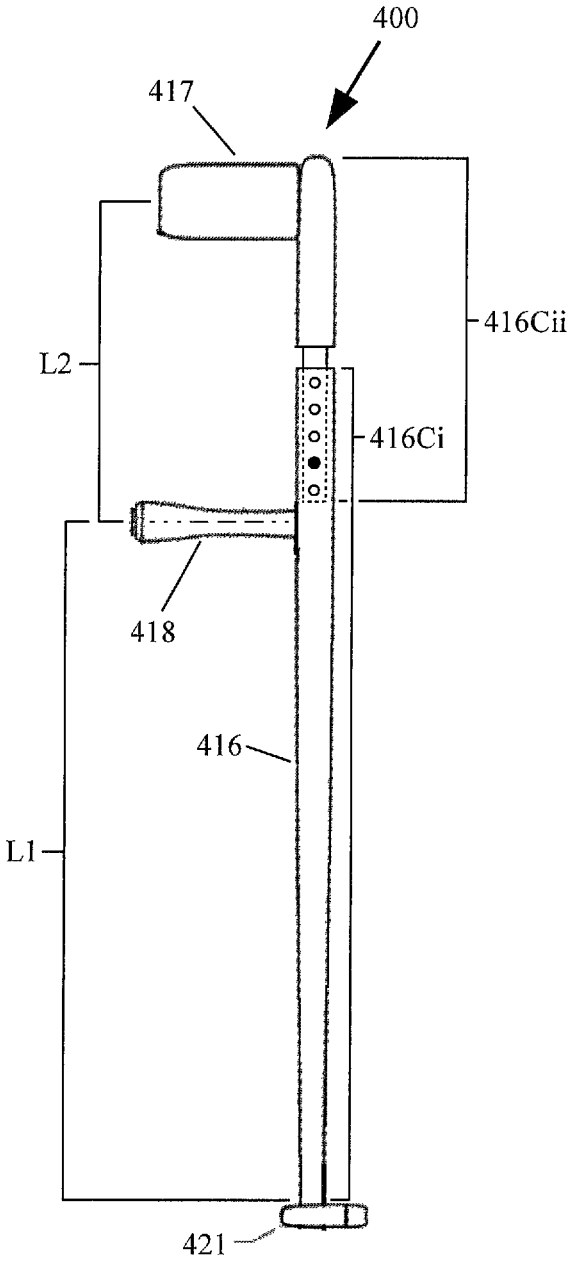
FIG. 8 is a second embodiment of a long handled nail trimmer that is used independently.

To better assist the elderly user in holding and maneuvering the long handled trimmer 200, a cuff 217 and a handle 218 are preferably incorporated into the extension arm 216. The cuff 217 can be received by, and be releasably secured to, the upper forearm or an upper arm portion of the user, while the person's hand may grasp the handle 218 to guide the motorized trimmer 221 in a much more easily controlled and very ergonomic manner (i.e., by supporting of the device at two regions). The handle 218 may extend from the extension arm 216 at an acute angle Θ to the axis of the arm, to be ergonomically grasped by the user, as shown for example in FIG. 3. In one embodiment the angle Θ may be in the range of 30 degrees to 45 degrees, and in another embodiment the angle may be in the range of 45 degrees to 60 degrees, and in another embodiment the angle may be in the range of 60 degrees to 75 degrees, and in other embodiments a combination of such ranges or a different range of other angles may alternatively be used (e.g., the handle 418 shown in FIG. 8 is oriented at about 90 degrees to the shaft). To further facilitate ease of use of the long handled trimmer 200, the operation of the DC motor (i.e., turning device on and off) may be controlled via a switch 219 that may be mounted at the end of the handle 218, and which may be toggled by the user's thumb. The switch may alternatively be positioned on the side of the handle 218 to be actuated by the user's forefinger and/or index finger similar to a trigger. Any suitable switch known in the art may be used.

Figure 6:
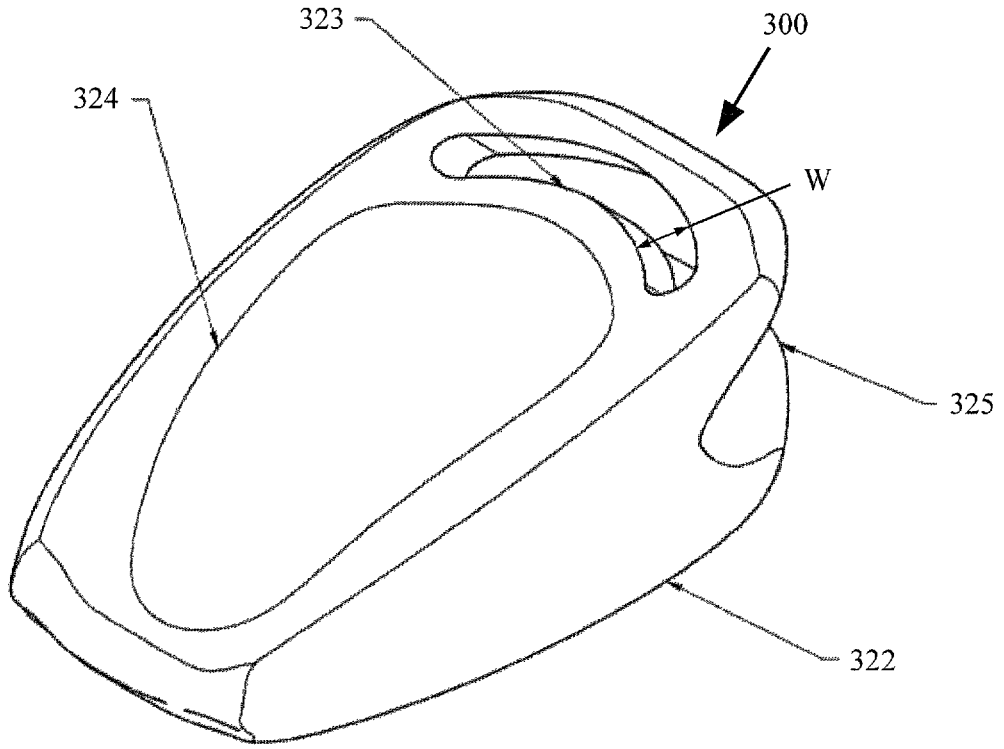
FIG. 6 is a perspective view of the base shown in FIG. 1.
Figure 7:
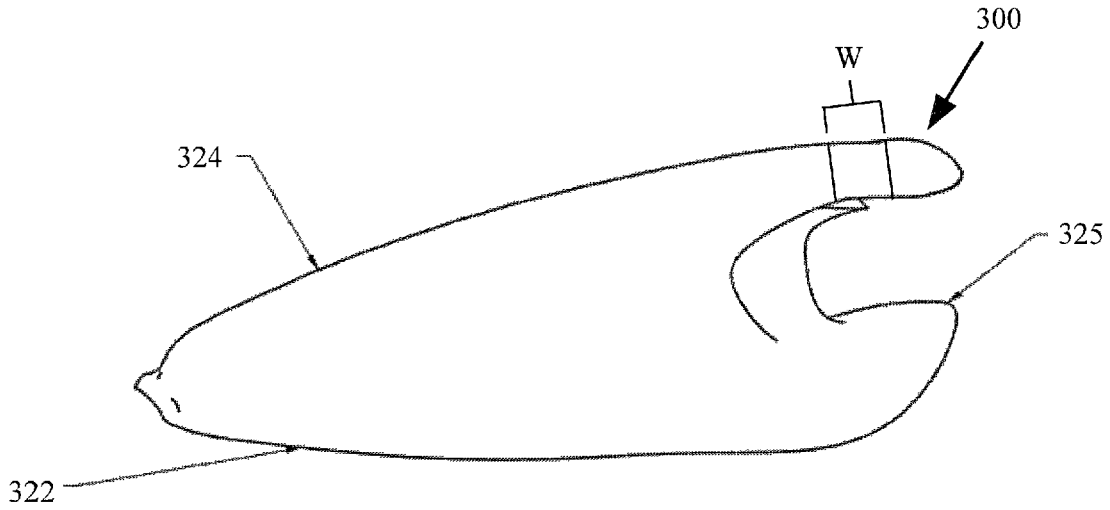
FIG. 7 is a side view of the base shown in FIG. 1.
Figure 7B:
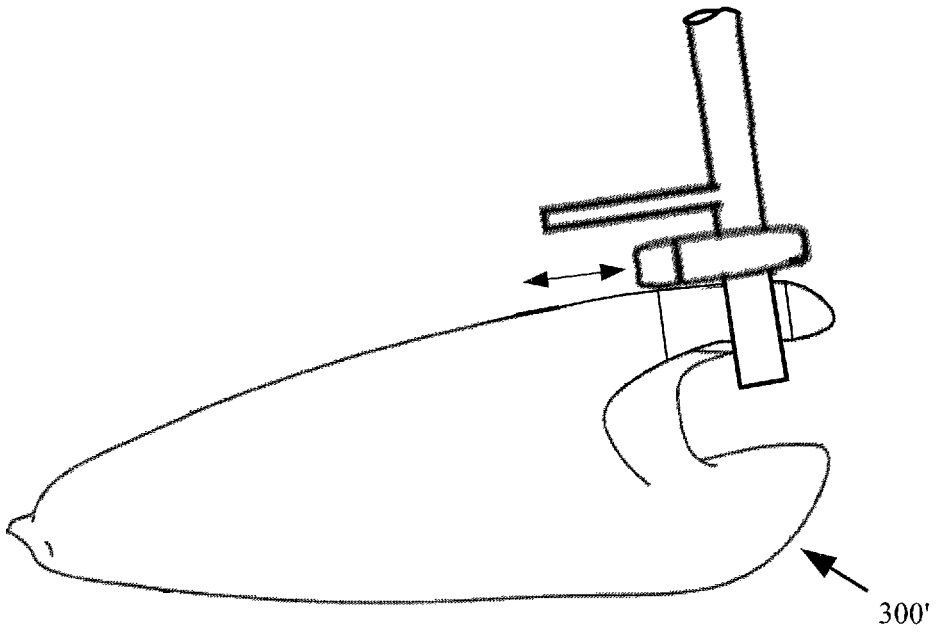
FIG. 7B is the side view of FIG. 7A, shown with a protruding portion of the shaft of the long handled trimmer received in the slot therein.

The support base 300 is shown in detail in FIGS. 6-7. The base 300 is unique and significant because it may provide additional stability for use of the long handled trimmer 200. The base 300 may further assist the elderly who tend to have far less arm motor control, which may make it difficult for them to hold the extension arm steadily enough to control the movement of the device with only their hand and arm, even with the addition of the cuff 217 and the handle 218.

The base 300 may have a foot pad 324 on an upper portion thereof that may be angled with respect to a bottom surface 322. The foot pad 324 may be a covering on top of the base to provide for extra support, comfort and grip for the user's foot, which covering may be formed of any suitable material including, but not limited to: natural rubber, synthetic rubber, etc. The base 300 may also have a slot 323 formed in the upper surface, which slot may be curved.

The base 300 may further have a recess 325 formed in the front portion to expose and interconnect with the bottom of the slot 323. The shape of the base 300 is preferably such that the front end that supports the toes is higher in elevation than the rear of the base where support is provided to the heel of the foot.

As may be understood from FIG. 1, the bottom portion of the extension arm 216 may be received in the slot 323 of the base 300. In one embodiment the top of the recess 325 (see FIG. 7) may be formed deep enough so that the first end 216*i* of the extension arm 216 may not contacted it, and the bottom of the housing 31 of the motorized trimmer 221 may contact the top of the base 300. In another embodiment, the top of the recess 325 (see FIG. 7) may be formed to a particular depth so that the first end 216*i* of the extension arm 216 does contact the base, and the bottom of the housing 31 of the motorized trimmer 221 is displaced from the top of the base 300. For either embodiment, the slot 323 provides a track for guiding/restricting the movement of the bottom of extension arm 216, to assist the user in moving the motorized trimmer 221 for trimming each of the nails on his/her toes of a foot, as it rests upon the foot pad 324 on the upper side of the base 300.

The use of low friction materials/coatings at the contact surfaces of the long handled trimmer 200 and the base 300 may further permit the elderly user to rest and lean more weight on the extension arm 216 through the arm cuff 217 and handle 218, while still being able to maneuver the device.

Figure 7A:
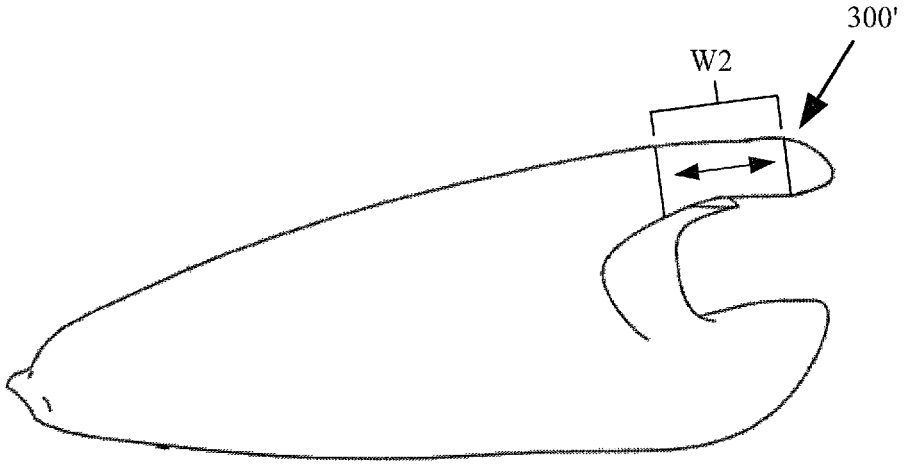
FIG. 7A is a side view of the base shown in FIG. 7, but with the curved slot shown having a larger width.

The curved shape of the slot 323 may be particularly tailored to match and accommodate only one foot geometry, as it is known that various different people have toes that may reflect his/her ancestry, including foot geometries referred to as: an Egyptian foot geometry; a Roman foot geometry; a Greek foot geometry; a Germanic foot geometry; and a Celtic foot geometry. (See e.g., "Foot Shape Ancestry: What You Toes Can Tell You," The Genealogy Bank, Nov. 15, 2018). Thus, a user may be able to select a base that matches his/her foot geometry (and may also select a base with a slot that matches the size of his/her foot). Alternatively, the shape of the slot may generalized, and may be generously oversized, whereby the width of the slot and a curved shape of the slot is formed so that it may provide sufficient clearance with respect to the bottom of the shaft protruding below the housing of the trimmer to permit the user to manipulate the long handled trimmer into contact with, and away from each toenail for various different foot geometries (compare width W for base 300 in FIGS. 6-7, with width W2 in FIG. 7A for base 300').

Unlike other devices in the field, the herein disclosed apparatus is unique in that its main components need not permanently connected and can be disassembled and reassembled/reattached, making it convenient to use and then store the apparatus.

In addition, users who have reach limitations can first unfold the sections of the extension arm 216 so that the arm is at its full length. Then extension arm 216 may be coupled to the base 300, which could already be on the floor, or be placed on the floor, so the user can drag and move the base to where it is conveniently positioned, now that the components are connected.

Another problem for an elderly user seeking to trim his/her toenails is straining their eyes and body to be able to look more closely at their toes as they are trimming those nails. For that reason, another embodiment may also include a magnifying glass 220 positioned proximate to, but slightly above, the motorized trimmer 221 so that users can view their toes more clearly as they insert their toenails one-by-one into the trimmer slot 15 of the shroud 28 for the nails to be trimmed by trimmer surface 10.

In addition, an LED light 2 may be positioned on the motorized trimmer 221, which may also be automatically turned on whenever the trimmer is on, so that the user can more easily view their toes even in dim lighting.

Another embodiment of the disclosed apparatus is shown in FIG. 8. The long handled trimmer 400 shown in FIG. 8 may be formed the same as the long handled trimmer 200, except that the motorized trimmer 421 may be positioned at the bottom of the shaft 416, as the device is intended to be utilized without the base 300. The long handled trimmer 400 shown in FIG. 8 may be formed with a single unitary shaft member 416, or alternatively, it may be formed of three sections that may releasably couple together, similar to the long handled trimmer 200. For any of the long handled trimmer embodiments disclosed herein, the shaft (e.g., shaft 416) may have a first portion being between the trimmer 421 and the handle 418 that may be formed to have a length L1 that may accommodate a particular user (e.g., the $50^{th}$ percentile 70 year old man or woman) holding the device with the trimmer being able to reach his/her toes while sitting on a chair, with the arm generally outstretched, being bent at least somewhat at the waist. The length L1 may alternatively be a little longer to accommodate a particular user holding the long handled trimmer 400 with the trimmer 421 being able to reach his/her toes while lying down on a generally flat surface (e.g., a floor or bed), with the arm outstretched (i.e., without being bent at the waist). Different size shafts may be utilized to accommodate different sized users, and different desired modes of use (sitting in a chair with legs bent, sitting on a flat surface such as a bed with legs outstretched, or even, in a different embodiment, while lying down). The shaft (e.g., shaft 416) may have a second portion being between the handle 418 and the support member (e.g., cuff 417) that may be formed to have a length L2 that may accommodate a particular user having his/her hand holding the handle 418 of the long handled trimmer 400, with the support member (e.g., the cuff 417) being so positioned to at least be securable to a portion of the user's forearm. The length L2 of the second portion of the shaft may alternatively be formed to be proportionately longer so that the cuff 417 may be positioned approximately midway on the upper arm of the user (i.e., midway between the elbow and the shoulder), as such positioning may accommodate a very large percentage of different sized elderly users.

Each of the herein disclosed long handle trimmer embodiments are advantageous over the prior art devices, for at least the reason that they provide two points of contact with respect to the user's arm (the handle grasped by the user and the support member coupled to the arm). Also, the distance between those two points (i.e., the length L2) provides leverage for the elderly user that may not otherwise have the strength to hold a trimming device with just his/her hand for the entire time necessary to trim each of the toenails. Therefore, it may be desirable to maximize the length L2 for each user, to place the cuff 417 on the upper arm as close to the shoulder as possible for greater leverage; as such, in another embodiment, adjustability may be provided to the second shaft portion, as shown in FIG. 8, whereby the shaft 416 may be formed to have an upper shaft section 416Cii, which supports the cuff 417, that may telescope into a lower shaft section 416Ci, which supports the handle 418. The shaft sections 416Ci and 416Cii may be releasably coupled together and adjustable using detent mechanism (e.g., a spring biased ball), which may serve to increase or decrease the length L2 as needed or desired. Note that the first shaft portion may also be formed to include telescoping shaft sections and similar adjustability for the length L1.

Figure 8A:
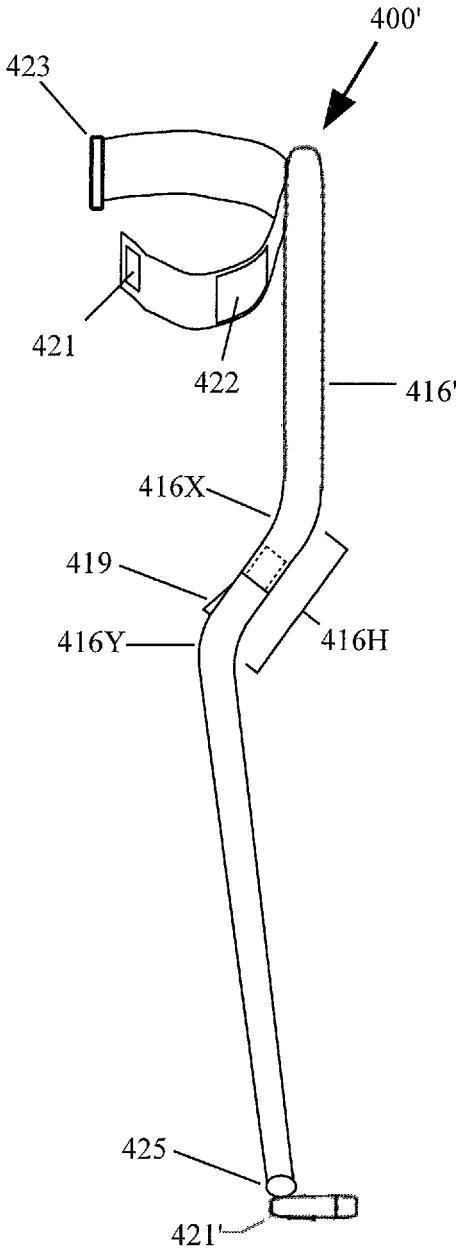
FIG. 8A illustrates another embodiment of a long-handled trimer embodiment that may be used independently, and which is formed similar to the embodiment shown in FIG. 8.

Although the long handled trimmer 400 is shown in FIG. 8 as having a shaft 416 formed to be straight—the same as the extension arm 216 for the long handled trimmer 200, and with a handle 418 that protrudes away from the extension arm 416 (both of which may nonetheless be integrally formed as a single unitary part)—a long handled trimmer 400' as seen in FIG. 8A may instead be formed without the laterally protruding handle. The long handled trimmer 400' may instead be formed with a shaft 416' that may have a first bend 416X and a second bend 416Y, which bends may form a handle portion 416H that may be ergonomically grasped by the user's hand, when the cuff is releasably secured to the user's forearm or a portion of the upper arm. The user's four fingers may wrap around that handle portion 416H of the shaft, as well as the user's thumb. The two bends 416X and 416Y may also be positioned and particularly formed, e.g., being particularly bent only in the plane of the page, and/or with at least one bend that may be out of plane of the page, to provide clearance with respect to the user's knee while the device is being used, which may be advantageous for a user who may be unable to straighten his/her legs adequately.

In this embodiment, as well as any of the above described embodiments, the device may include an on/off switch 419, which may be a push-button electrical switch where the button is biased into the off position, so that the user must apply pressure to the button (e.g., using his/her thumb) to oppose the biasing to toggle the switch into the on position, i.e., a momentary switch (see e.g., U.S. Pat. No. 3,809,839 to Beddoe). Therefore, if the user decides to stop the device, he/she may immediately release his thumb from applying pressure to the momentary switch, and it will automatically shut off the trimming apparatus.

Also, as illustrated in FIG. 8A, any of the embodiments disclosed herein may alternatively utilize other apparatus for releasably coupling the upper end of the shaft 416 to the upper end of the user's arm. For example, rather than a cuff, the shaft 416 may have one or more straps fixedly secured to the distal end. The one or more straps may be configured to be secured with respect to the user's forearm or upper arm in any suitable manner.

For example, the one or more straps may be a single strap secured to the upper end of the shaft, and which may have secured thereto a piece of hook material 421 and a piece of loop material 422 (i.e., descriptive names for such materials that are sold under the trademarked name of VELCRO®). The hook material and loop material may be positioned on the strap to releasably secure the strap to itself after being wrapped around the upper forearm (i.e., between the wrist and elbow), or a portion of the upper arm of the user (i.e., between the elbow and shoulder). Alternatively, as seen in FIG. 8A, an elongated ring 423 may be positioned on one end of the strap, and the other end of the strap may be fed through the ring and be wrapped back upon itself and then be secured using the hook and loop materials 421 and 422. In yet another embodiment, the one or more straps may include first and second straps which may respectively have hook and loop materials 421 and 422 thereon that may be similarly secured. In a further embodiment, rather than using hook and loop materials, magnets may instead be used to releasably couple the strap(s) around the user's arm. In a different embodiment, rather than using hook and loop materials or magnets, buckles may be used at the ends of the straps, which may be a buckle configured to leverage and tighten the strap similar to a ski boot buckle or a knee brace buckle (see e.g., U.S. Pat. No. 4,428,369 to Peckham). In yet another embodiment, a cuff or straps or buckles may not be utilized at all, and the upper end of the shaft may have an elastomeric band that can be drawn over the user's arm to support that end of the shaft with respect to the arm.

Also, in another embodiment, as seen in FIG. 8A, the head may be interchangeable using a coupling 425, permitting use of a larger motorized trimming head with a large opening for the big toe, and a smaller motorized trimming head with a smaller opening for the remaining toes.

Also, in yet a further embodiment, as seen in FIG. 8A, the head 421' may be coupled to the shaft using the coupling 425 that may be a pivotable joint. The pivotable joint 425 may permit pivoting about one axis, or two axes, or it may be a spherical coupling permitting a limited amount of pivoting of the head about multiple axes simultaneously (e.g., a cone of movement with a 5 degree to a 25 degree included angle). The pivotable head may help assist the user in positioning his or her toenail in the slot, when the device is angle, such as when holding the device in the right hand and attempting to trim the little toe of the left foot.

The cutting apparatus in the head may be battery powered or may receive power from a cord configured to be plugged into a conventional electrical outlet.

Figure 9:
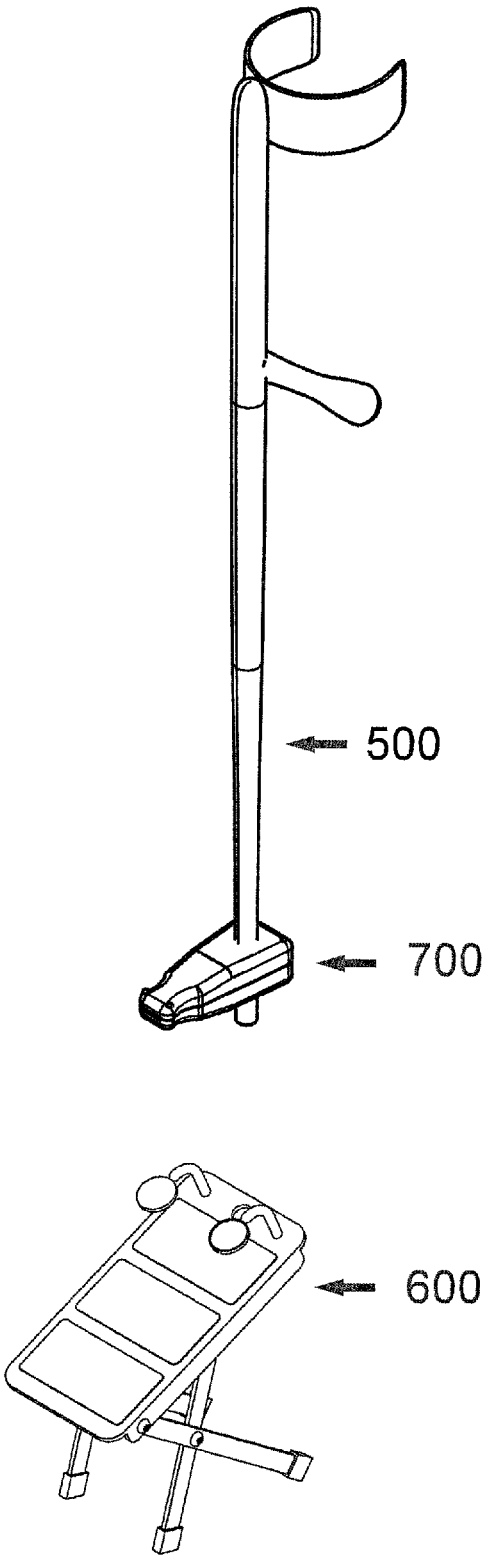
FIG. 9 is another embodiment of a long-handled trimmer with flexible belt sander and toe separators trimmer configured to cooperate with the foot support base also shown therein.
Figure 17:
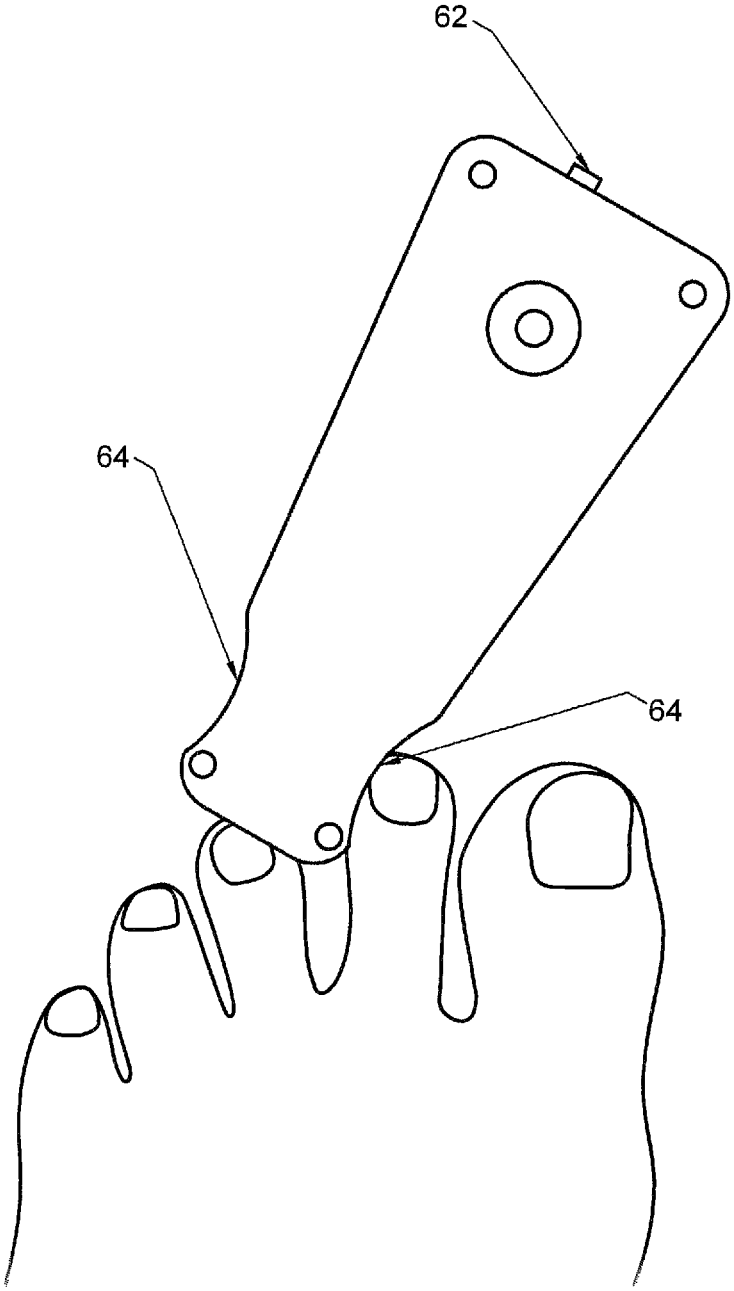
FIG. 17 is a top down view of the trimmer shown in FIG. 9, as it is being used to trim one of the toenails of a user's foot.

Another embodiment of the disclosed apparatus is shown in FIG. 9. The long handled trimmer 500 shown in FIG. 9 may be formed the same as the long handled trimmer 200, except that it may include a motorized trimmer 700 that may utilize a flexible sanding belt 55, and may have particularly contoured housing features 64, as seen in FIG. 17, that may be used to separate the user's toes. The rounded portion of the housing feature 64 may be placed against the adjacent toe, as shown in FIG. 17, and the trimmer may be rotated into contact with the toe that is to be trimmed, receiving the corresponding toenail through the opening in the housing, with the corner of the housing positioned between the two toes.

Figure 10:
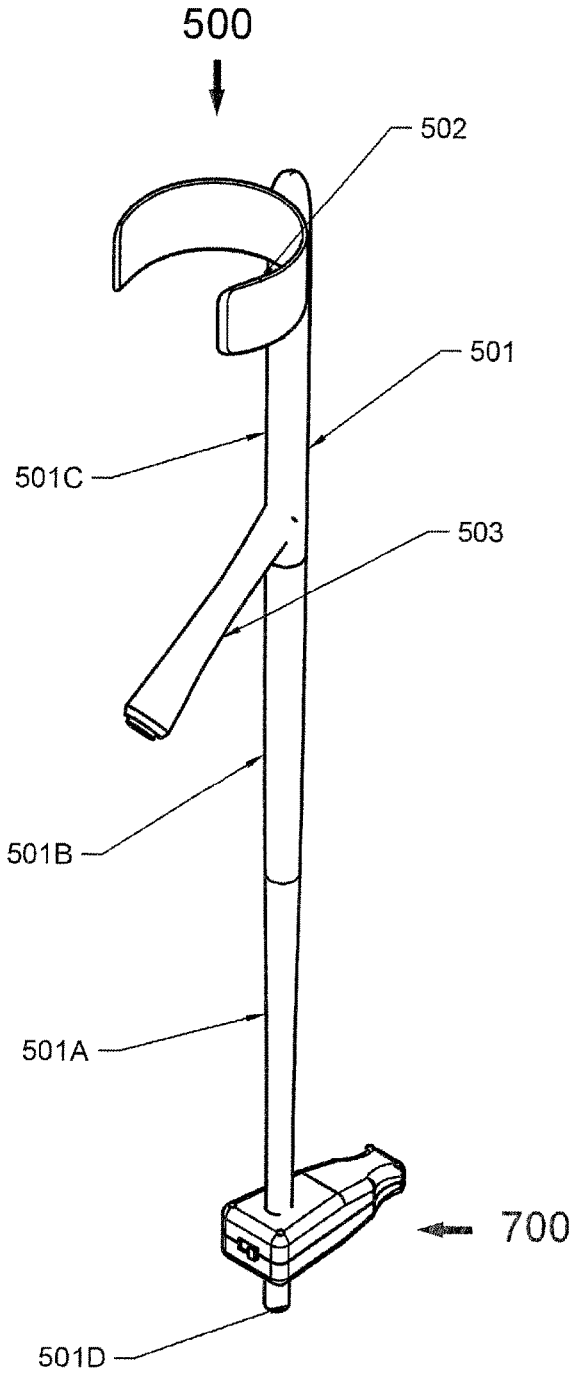
FIG. 10 is a perspective view of the long handled nail trimmer shown in FIG. 9.
Figure 11:
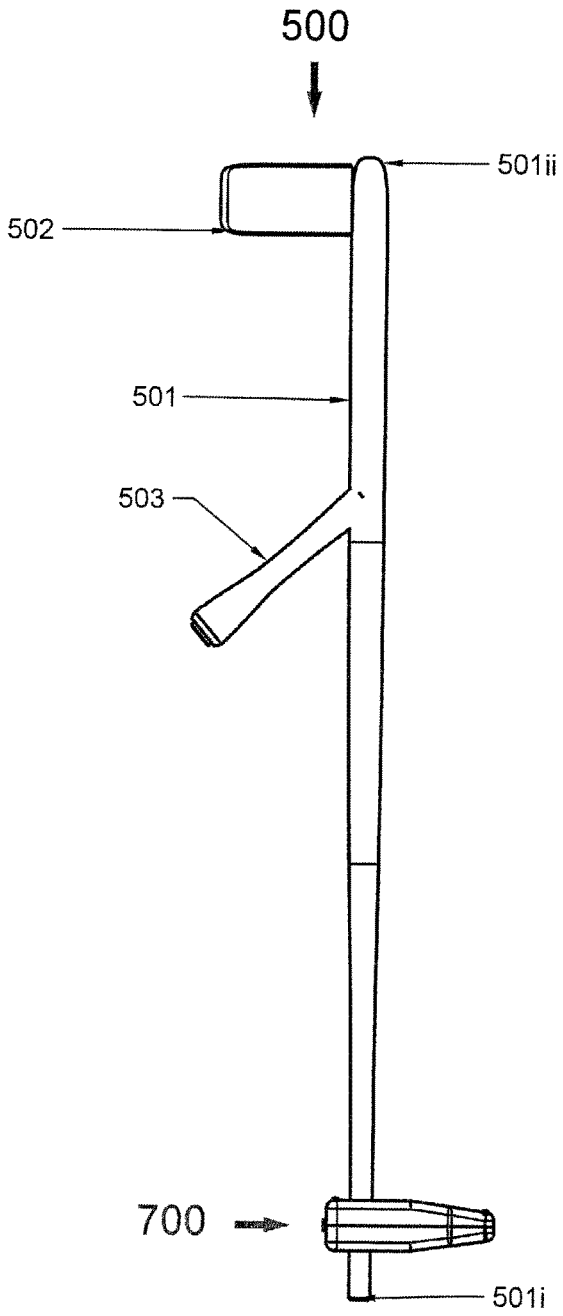
FIG. 11 is a side view of the long handled nail trimmer shown in FIG. 9.
Figure 12:
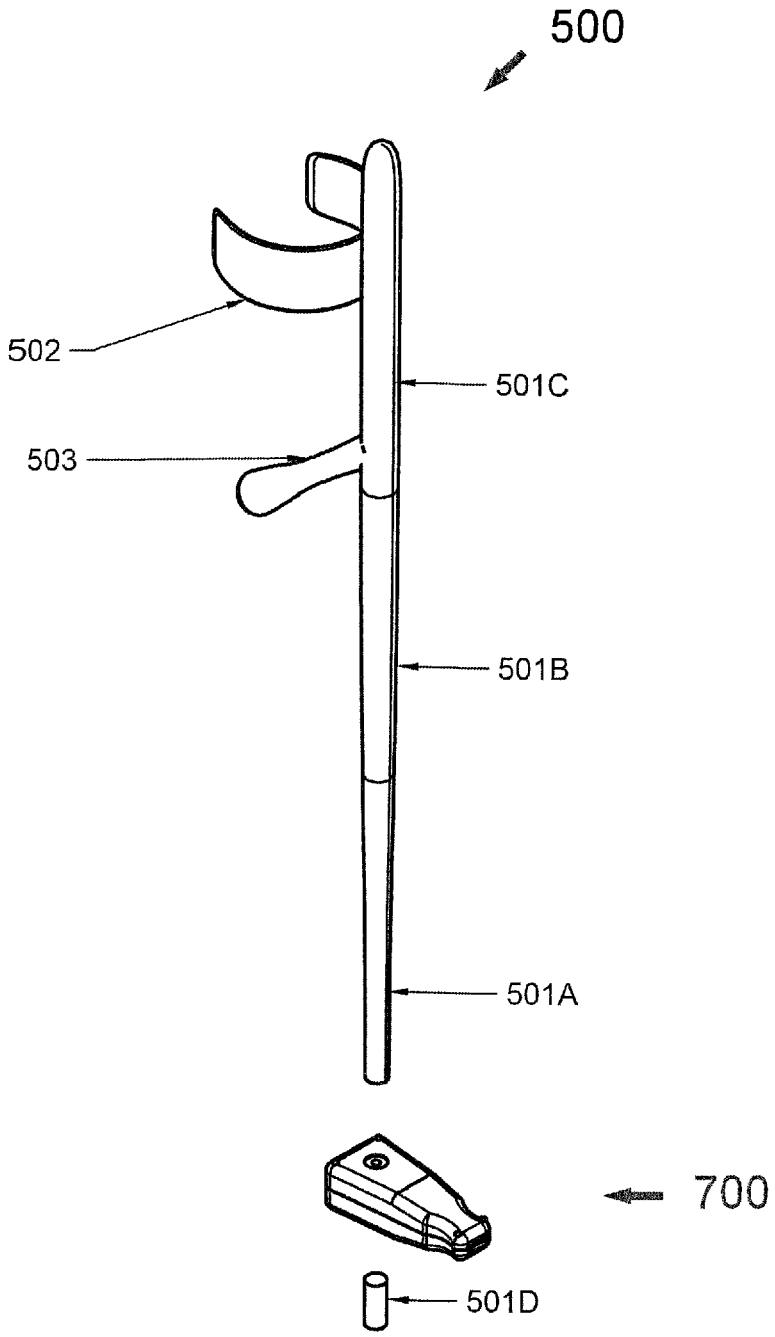
FIG. 12 is an exploded perspective view of the component parts of the long handled nail trimmer shown in FIG. 11.

The long handled trimmer 500 is shown in detail in FIGS. 10 and 11. The long handled trimmer 500 may be formed to include an extension arm 501, a motorized trimmer 700, an arm cuff 502, and a handle 503.

The extension arm 501 may share the same characteristics of the extension arm 216 in regards to extending from the first end 501*i* to the second end 501*ii*. The arm breaks down into segments for portability: the first section of the extension arm 501A, second section of the extension arm 501B, and the third section of the extension arm 501C. The fourth section of the extension arm 501D, may be attached to the bottom of the motorized trimmer 700 to form the full embodiment of the long handled trimmer 500 to slot into the hole of the base 353.

To better assist the user in holding and maneuvering the long handled trimmer 500, a cuff 502 and a handle 503 may be incorporated into the extension arm 501. This cuff 502 and handle 503 perform similarly to the cuff 217 and handle 218 of the long handled trimmer 200.

Figure 13:
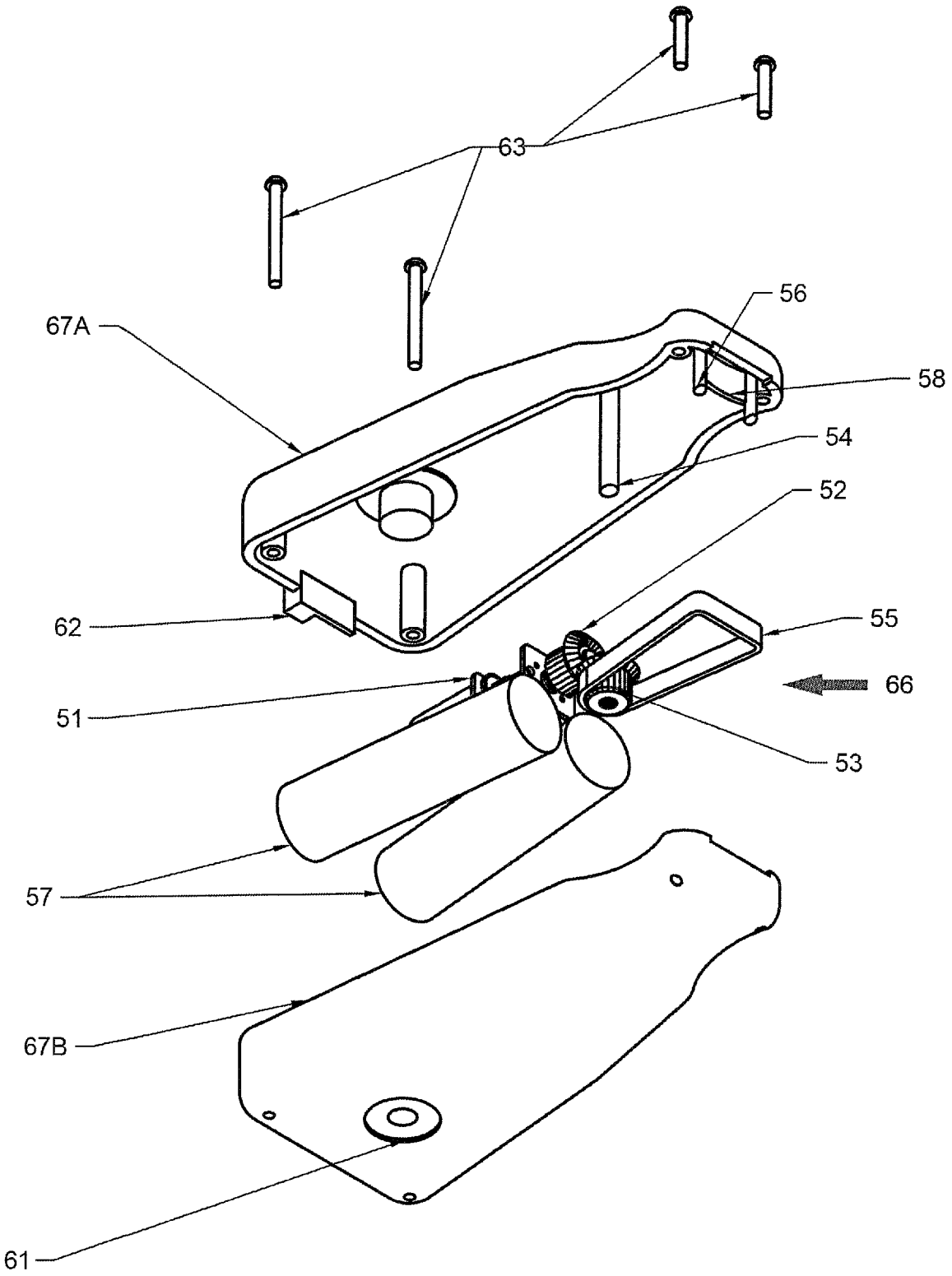
FIG. 13 is an exploded perspective view of the component parts of the motorized nail trimmer of the long handled nail trimmer device shown in FIG. 9.
Figure 14:
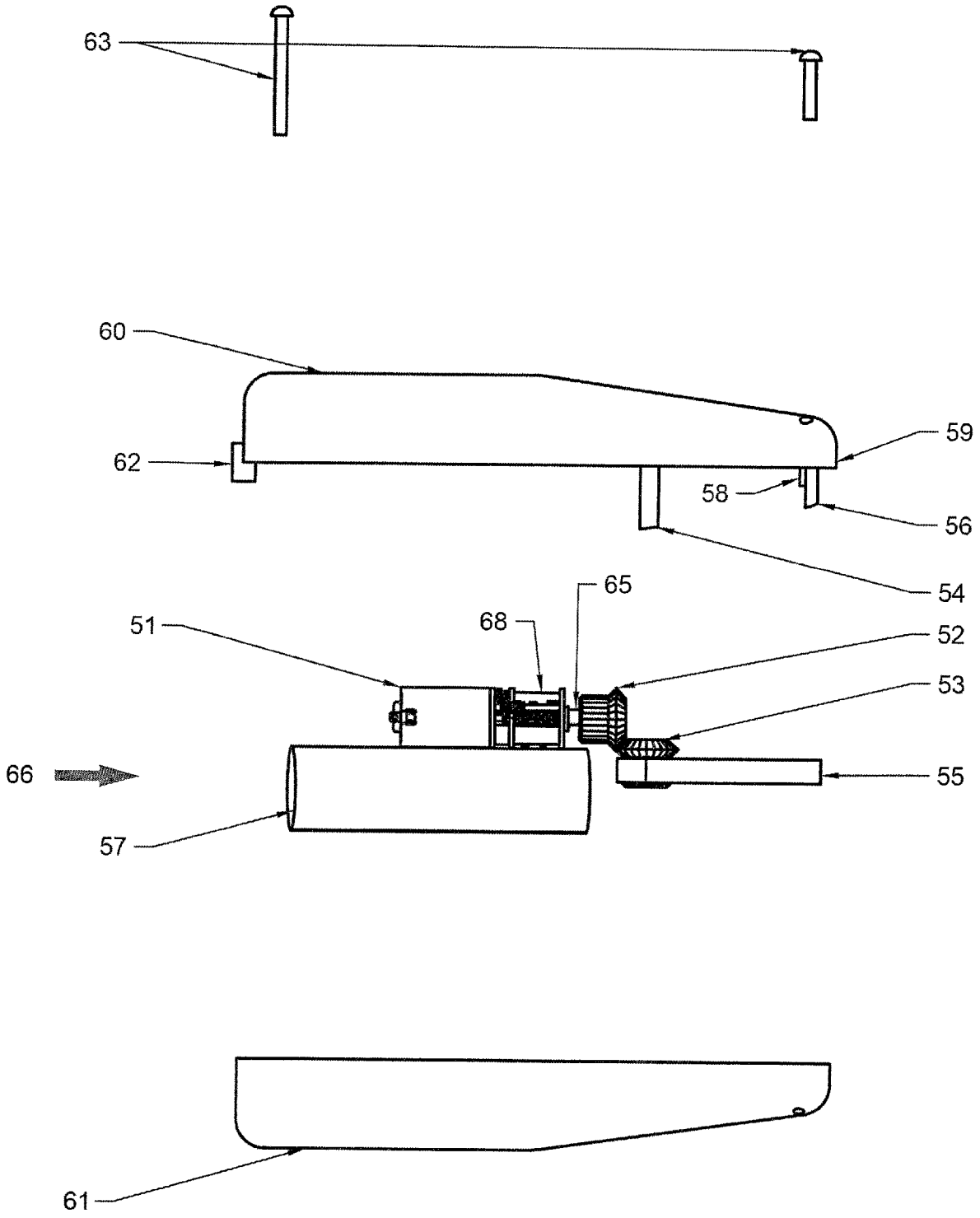
FIG. 14 is an exploded side view of the component parts shown in FIG. 12.

The motorized trimmer 700 may be positioned proximate to the first end of the extension arm. As shown in detail within FIG. 13 and FIG. 14, the motorized trimmer may include two portions: a driver/trimmer unit 66, and housing 67.

The driver/trimmer 66 unit may include a DC motor 51 with a primary motor shaft 65, and a torque geared gearbox 68. The DC motor may be powered by the battery 57, which may be in two cells. The motor may be turned on and off by a switch 62. The driver/trimmer unit may also include a main drive gear 52, and drive bevel gear 53 which actuates the flexible sanding belt 55. The path of the flexible sanding belt is defined around the drive bevel gear 53 and front belt pins 56, which may be joined by the nail support plate 58.

The main drive gear 52 is configured to be driven by the primary motor shaft 65 of the DC motor. The main drive gear 52 meshes with the drive bevel gear 53 which rotates around the driver bevel gear shaft 54 which drives the flexible sanding belt 55.

Figure 15:
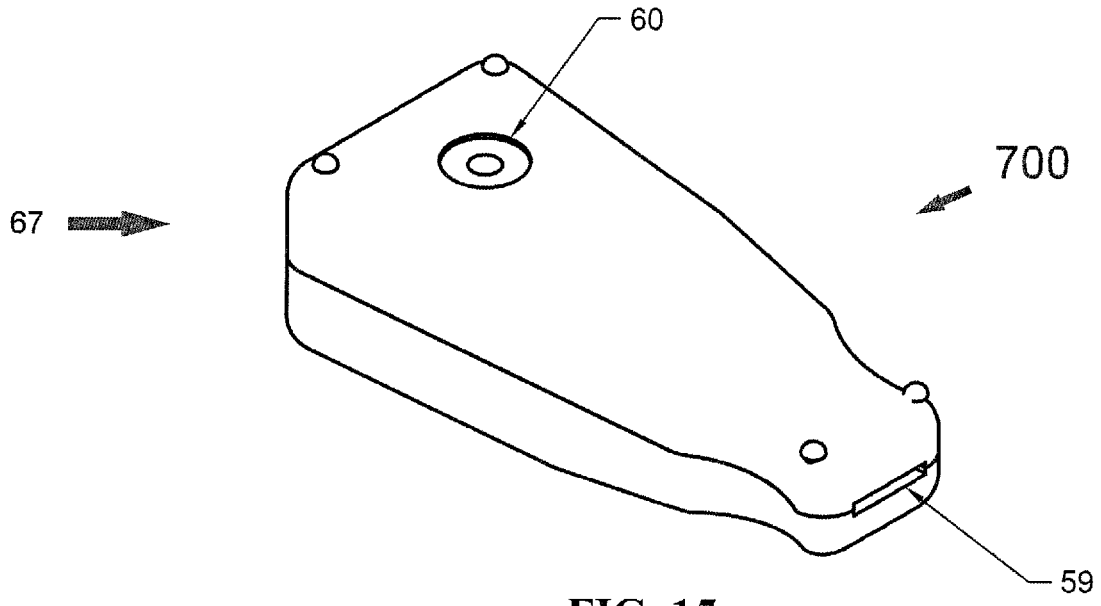
FIG. 15 is a perspective view of the trimmer shown in FIG. 9.

The housing may be made up of top portion 67A and bottom portion 67B which may be connected with screws 63 or other mechanical fasteners. The front of the housing unit may be formed to include a nail trimming slot 59, and toe separators 64 as shown in FIG. 15 and FIG. 17. The top may include a recessed indentation 60 and the bottom may include a recessed indentation 61 which may connect to the extension arm. These indentations may utilize mechanical threads or other quick release mechanisms to connect to the extension arm.

The housing is constructed so that the wall in which the nail trimming slot 59 is formed may be in close proximity to the trimmer surface (i.e., being separated therefrom by a distance of between 0.005 inches and 0.010 inches in one embodiment, and between 0.010 inches and 0.015 inches in another embodiment, and between 0.015 and 0.025 inches in another embodiment, although other distance ranges or a combination of such distance ranges may also be used in other embodiments). The separation distance from the trimmer surface is preferably small enough to permit sufficient trimming of the user's toenail, while being safe in terms of preventing contact of the soft tissue of the person's toes therewith, which is also prevented by the narrow height of the trimming slot 59. Accordingly, the trimmer slot 59 allows the toenail to be trimmed by the trimmer surface without touching the skin of the toe.

The housing permits removal and replacement of the component parts of the drive/trimmer unit.

Figure 16:
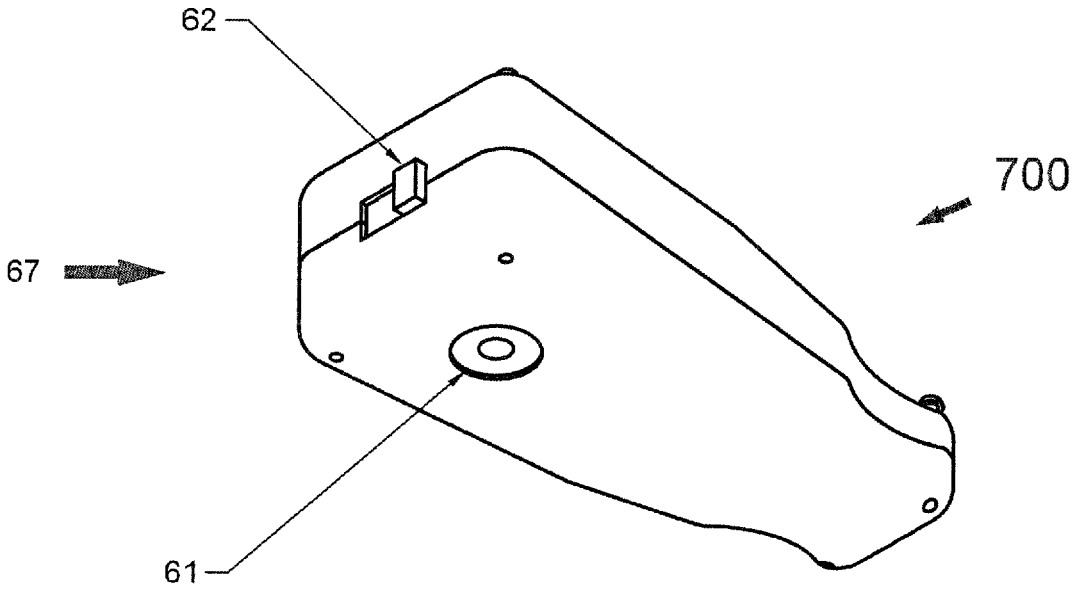
FIG. 16 is another perspective view of the trimmer shown in FIG. 9.

The motorized trimmer 700 may be secured to the extension arm 501 in any suitable manner, including, but not limited to being welded thereto, being mechanically fastened thereto, etc. In another embodiment, that is shown in the figures the housing may be formed with indentations (see FIGS. 15 and 16) to receive the extension arm from above with 501A, and below with 501D.

Figure 18:
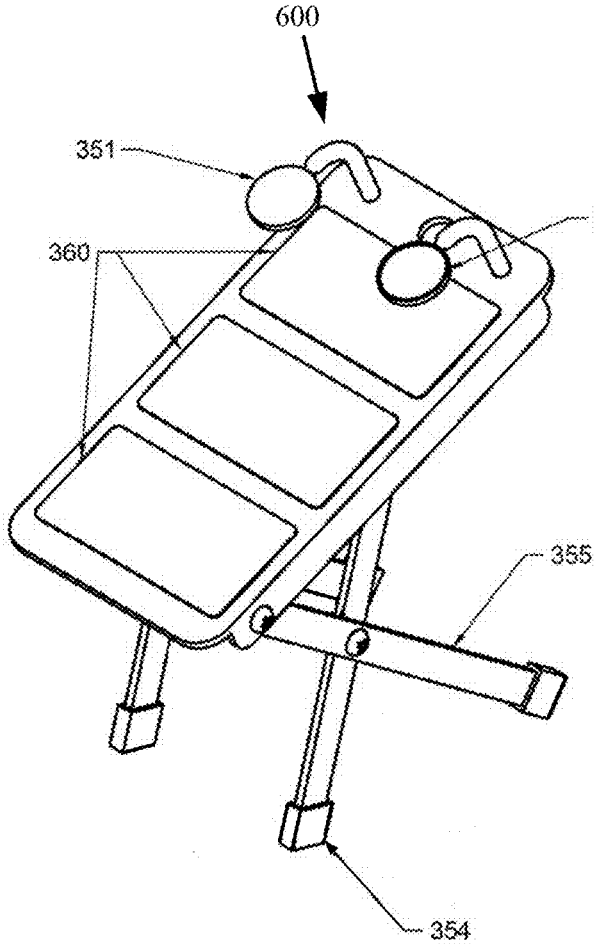
FIG. 18 is a top perspective view of the base shown in FIG. 9.
Figure 20:
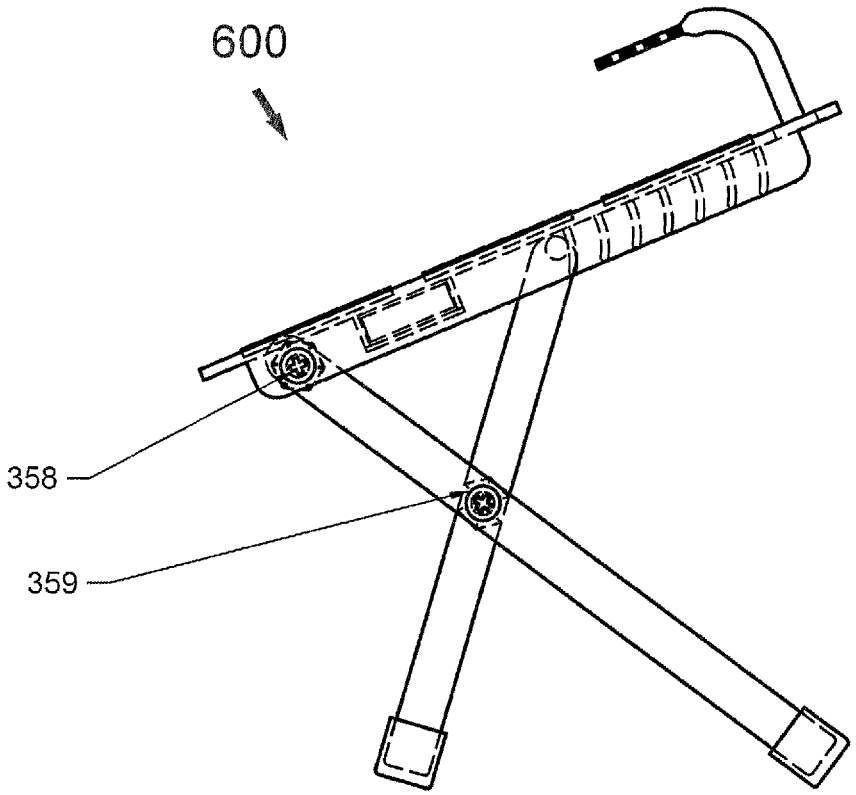
FIG. 20 is a side view of the base shown in FIG. 9.
Figure 21:
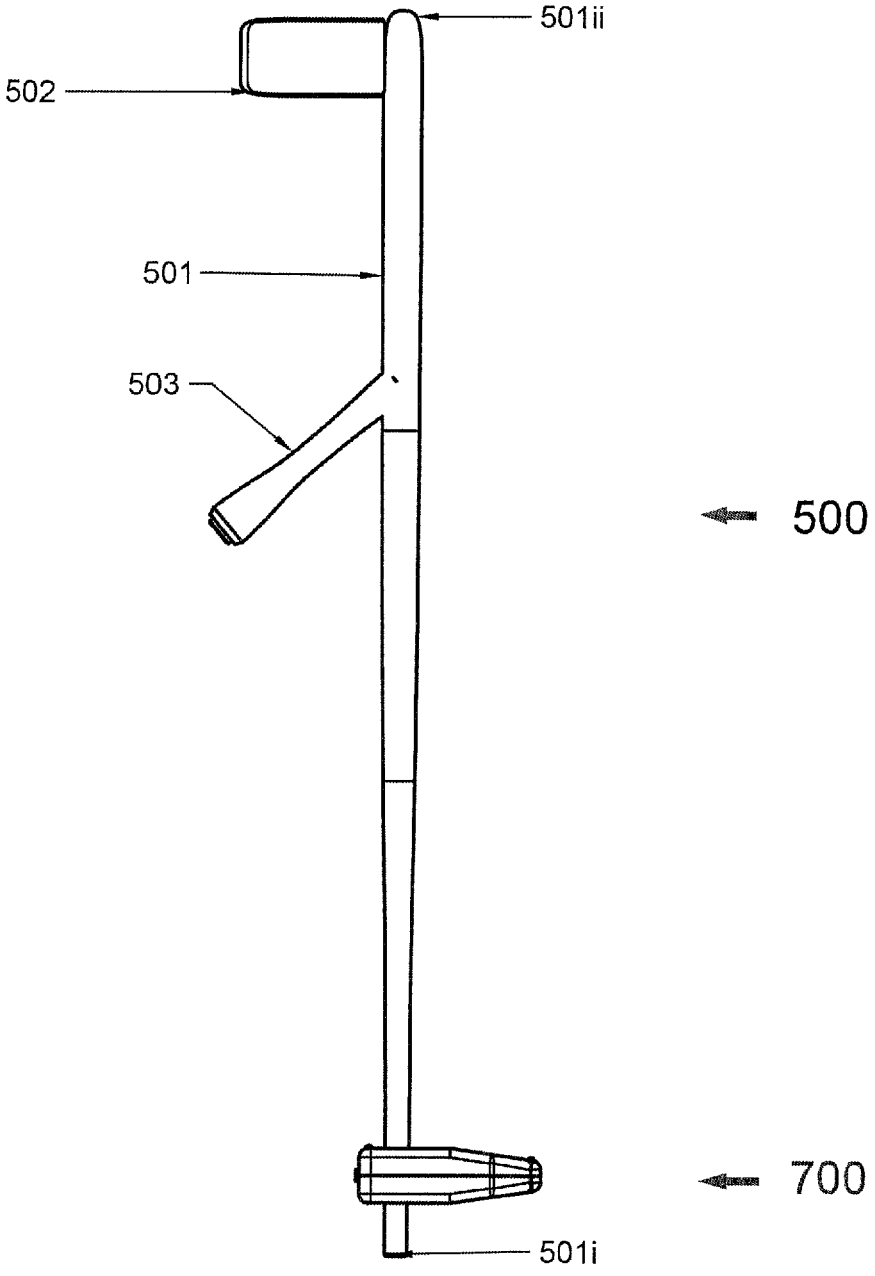
FIG. 21 is a fourth embodiment of a long handled nail trimmer that is used independently.

The support base 600 may have foot pads 360 on the upper portion thereof that may be angled with respect to the ground as shown FIG. 18. The foot pads 360 may be a covering on top of the base to provide for extra support, comfort, and grip. The base 600 may also have a hole 353 formed in the upper surface, which may be elongated into the shape of a slot. The hole 353 may receive the extension arm segment 501D to form the embodiment shown in FIG. 9. The base 600 may be adjustable to several heights and angles as shown in FIG. 20. The base is supported by legs 355 which pivot around the base-leg pivot point 358 and the leg-leg pivot point 359 in FIG. 20. These pivot points allow the leg support beam 356 to fit into the beam teeth 361. The legs may be covered by rubber leg covers 354 to make the base more slip resistant.

Figure 19:
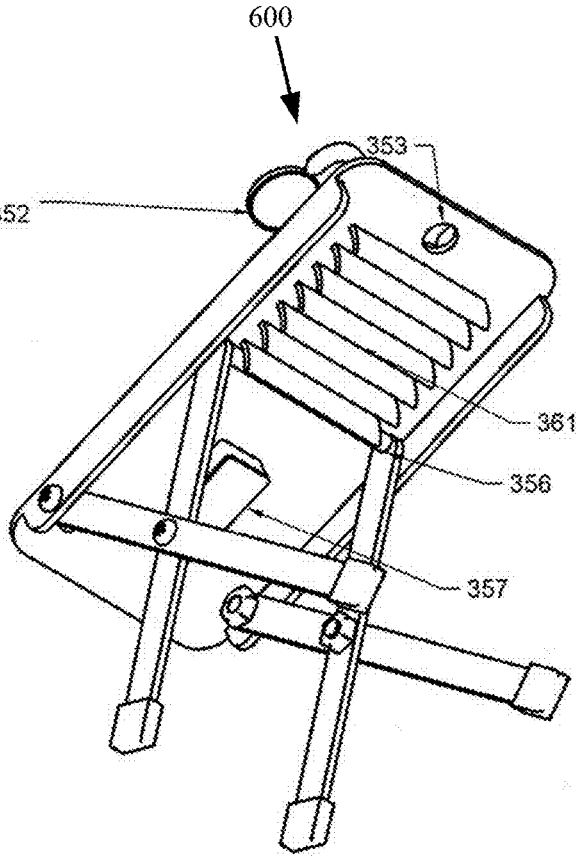
FIG. 19 is bottom perspective view of the base shown in FIG. 9.

Another embodiment may also include a magnifying glass 352 positioned above the upper surface as shown in FIG. 19. In addition, an LED light 351 may be positioned on the base to illuminate the toes and improve visibility. The LED light may be powered by a battery 357.

The above embodiments provide for removal of a portion of the housing (e.g., the shroud) and/or removal of the entire trimmer head (which also permits use of the device for trimming of fingernails) in exchange for a corresponding replacement shroud/trimmer head that includes a different sized opening, to better accommodate the nail size of the big toe, and/or the smaller nail size of the remaining toes/fingers.

Figure 22:
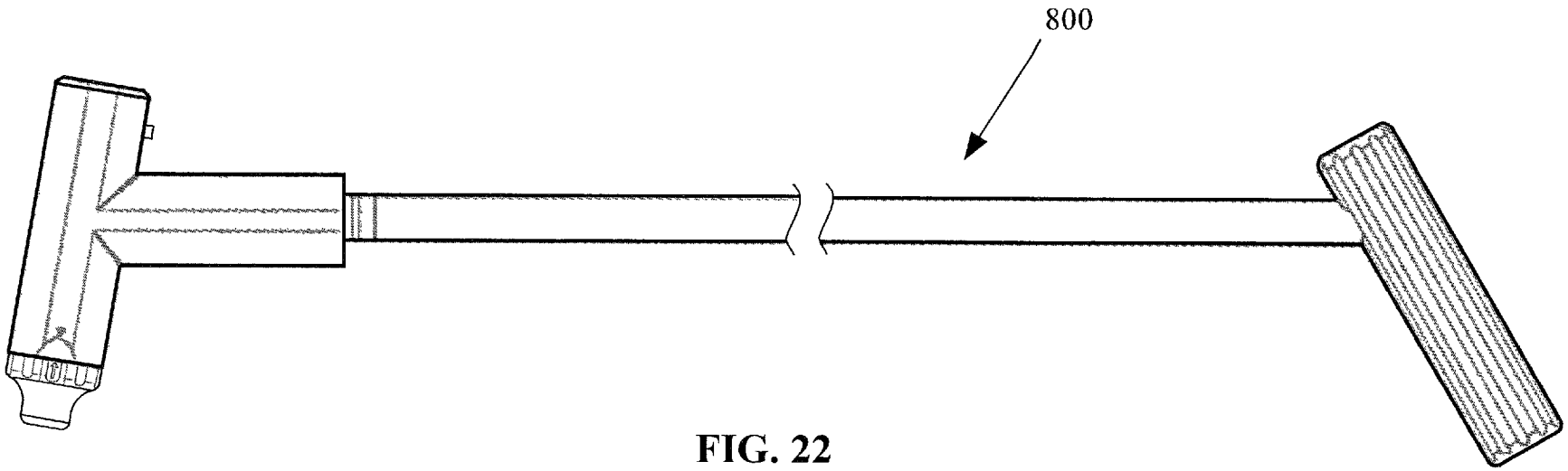
FIG. 22 is a side view illustrating an electric nail groomer that is convertible between two different configurations, one configuration with a shaft releasably attached to the grooming head to provide extended reach for filing of toenails, and the other configuration with the shaft detached from the grooming head, for convenient use of the grooming head by itself for filing of fingernails.

At least some of these same features may be included in the nail groomer 800 shown in FIG. 22. The nail groomer 800 may be configured for convertibility, being able to operate in a first configuration that is particularly adapted for filing toenails (see e.g., FIG. 24), in which the shaft/handle is releasably coupled to the grooming head, and to alternatively be converted to operate in a second configuration that is particularly adapted for filing fingernails (see e.g., FIG. 27), in which the shaft/handle has been removed from the grooming head.

Figure 24:
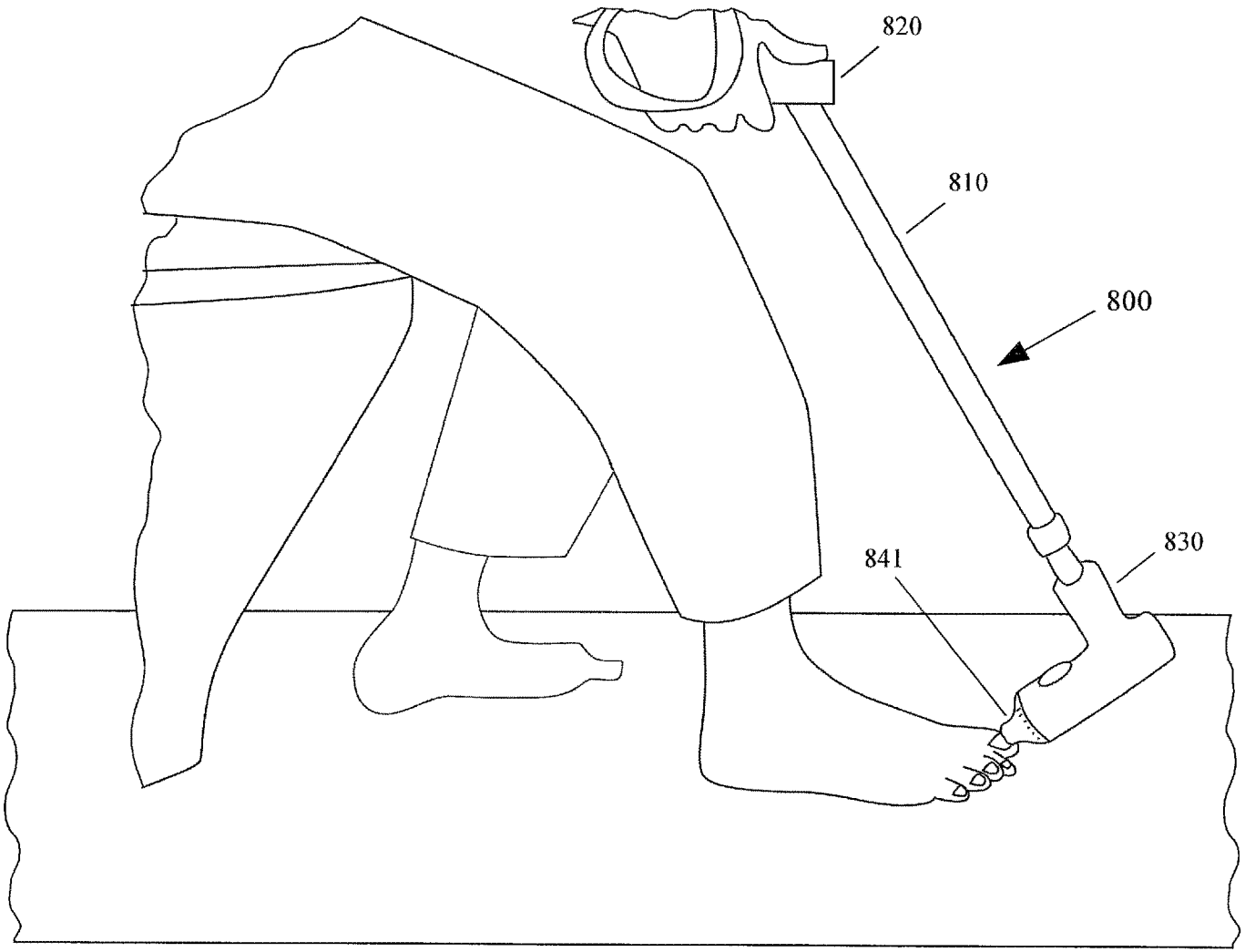
FIG. 24 is a perspective view of the long handled nail groomer of FIG. 22 being utilized by a person to file his/her toenails, while seated.

As seen in FIG. 24, operative use of the nail groomer 800 for filing of toenails may have it formed so that it may include: a shaft portion 810, a handle portion 820, a grooming head 830, and one or more filing caps (e.g., filing caps 841, 842, and 843).

Figure 23:
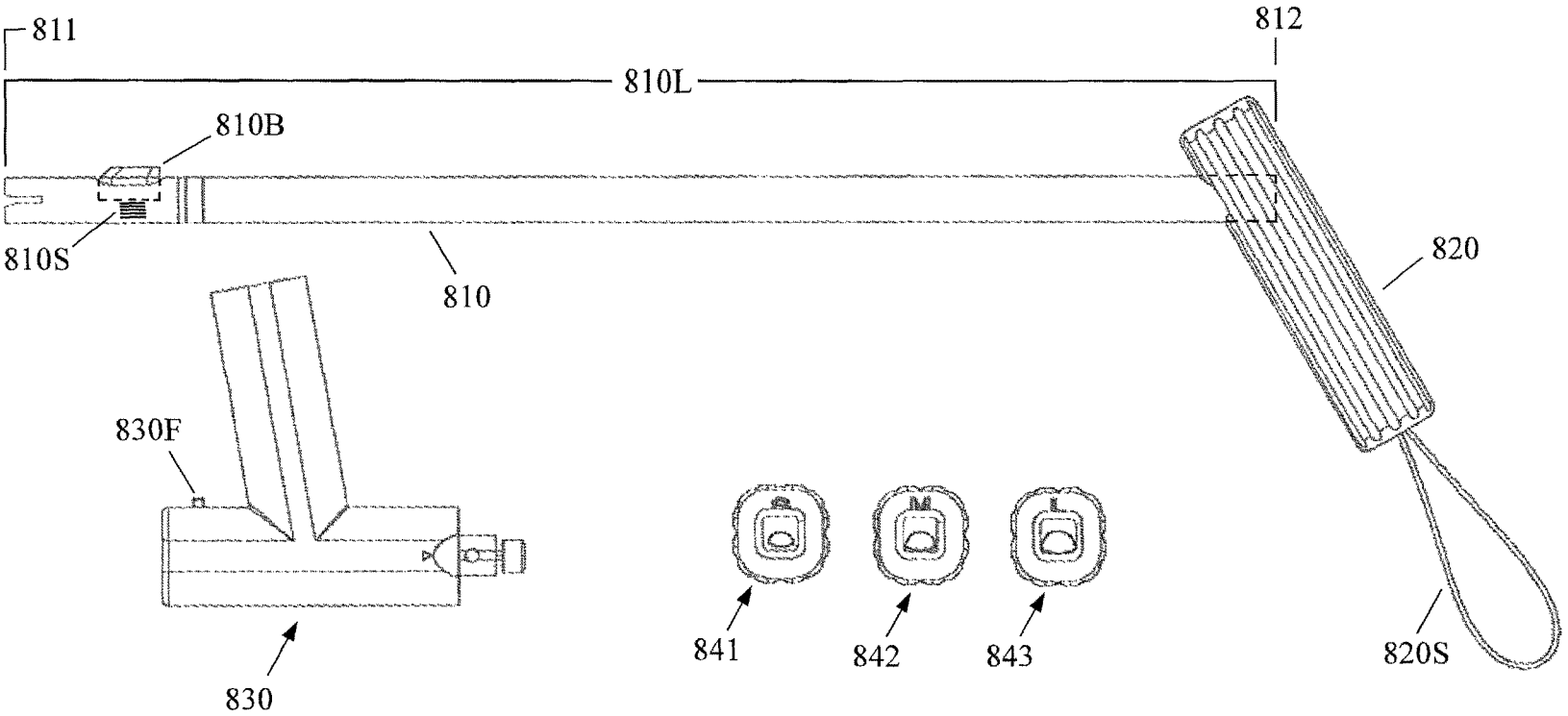
FIG. 23 is an exploded view showing the readily detachable portions of the long handled nail groomer of FIG. 22.
Figure 43:
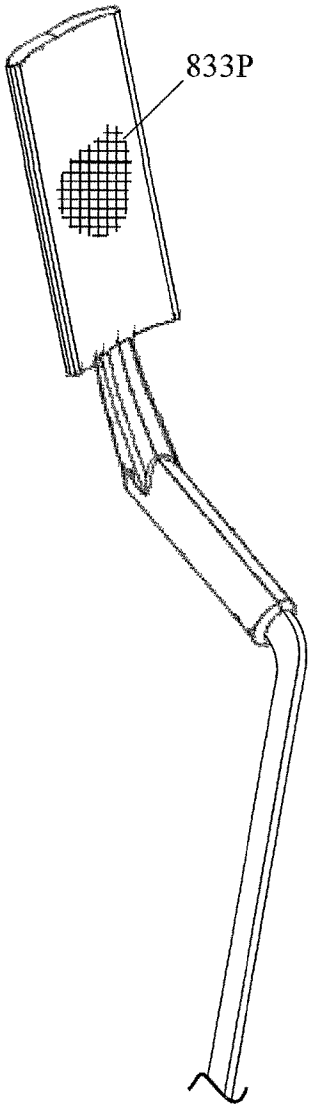
FIG. 43 shows a different embodiment of shaft and handle than is illustrated in FIG. 42, with the shaft and the handle instead being integrally formed as a single unitary part.
Figure 42:
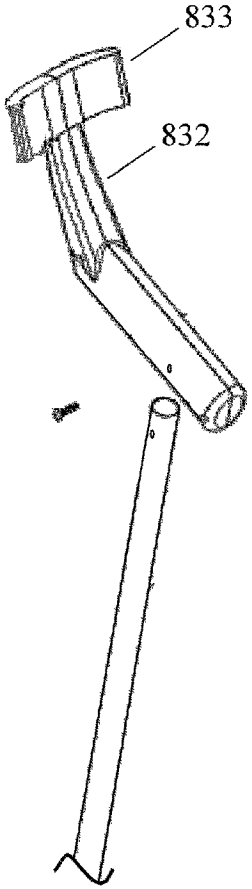
FIG. 42 illustrates another embodiment of a handle, which has a cuff that does not wrap around the user's forearm or upper arm, and merely contacts a portion thereof, and which handle is shown just prior to being coupling to a shaft.

At least a portion of the handle portion 820 may be configured to be ergonomically grasped by a hand of a user to manipulate the nail groomer 800, and may therefore include a plurality of undulations (see FIG. 22), or indentations for each finger (see e.g., U.S. Pat. No. 5,927,533 to Payne), and/or a contoured rubber coating, etc. In one embodiment, the shaft portion 810 and the handle portion 820 may be formed as separate parts that may be fixedly secured together using, for example, screws, a bolt and nut, adhesive, etc., as shown in FIG. 23 and FIG. 42. In another embodiment, the shaft portion 810 and the handle portion 820 may be formed as a single unitary part (which combination may be termed an extension arm), such as, for example, when formed of a plastic material using an injection molding process (see e.g., FIG. 43).

Figure 23A:
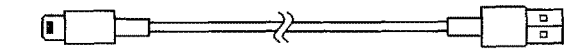
FIG. 23A is a top view of a USB cable usable for charging the rechargeable batteries of the device of FIG. 22.
Figure 40:
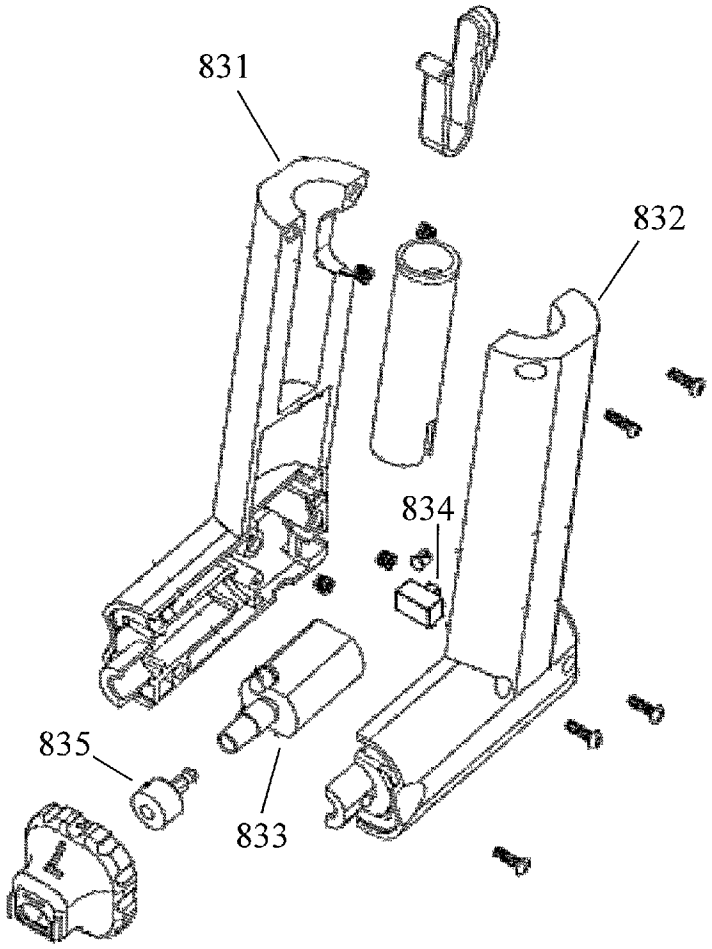
FIG. 40 is an exploded view of the component parts of the grooming head of the long handled nail groomer of FIG. 22.

As may be seen in the exploded view of FIG. 40, the grooming head 830 may be formed of a housing, which may be a two-piece housing made up of a first portion 831 and a second portion 832. The grooming head 830 may also have a motor 833 mounted to a portion of the housing, and electronics that may be oriented vertically using a custom printed circuit board (PCB) assembly and design. The grooming head 830 may have a USB C port 834 configured to receive one end of the cable 899 shown in FIG. 23A, where rechargeable batteries are used to power the device, for easy recharging of those batteries. Additionally, or alternatively, the nail groomer 800 may be powered using an electrical cord that may plug into a standard wall electrical outlet. The on/off switch 830F may be positioned anywhere on the grooming head, and need not be positioned as shown in FIG. 23.

A filing bit, e.g., filing bit 835, may have a first portion that may be secured to a portion of the motor, either being fixedly secured or releasably secured thereto, and may have a second portion that may be formed to include an abrasive surface. The motor is thus configured to rotate the filing bit, permitting its abrasive surface to abrade a portion of a toenail and/or fingernail.

The abrasive surface 835F on the filing bits may be similar in nature to sand paper. Since the abrasive surface 835F will diminish with respect to its nail filing capacity over time, a releasable coupling arrangement for the filing bit and motor may be preferred (see e.g., U.S. Pat. No. 3,807,745 to Bent, and U.S. Pat. No. 4,880,246 to Rohm). It is also contemplated that various different filing bits 835 may be formed and be available to the user, which different bits may have different grits for the roughness of the abrasive surface, to accommodate the desired speed of abrasion/filing of the nails for different users.

Figure 45:
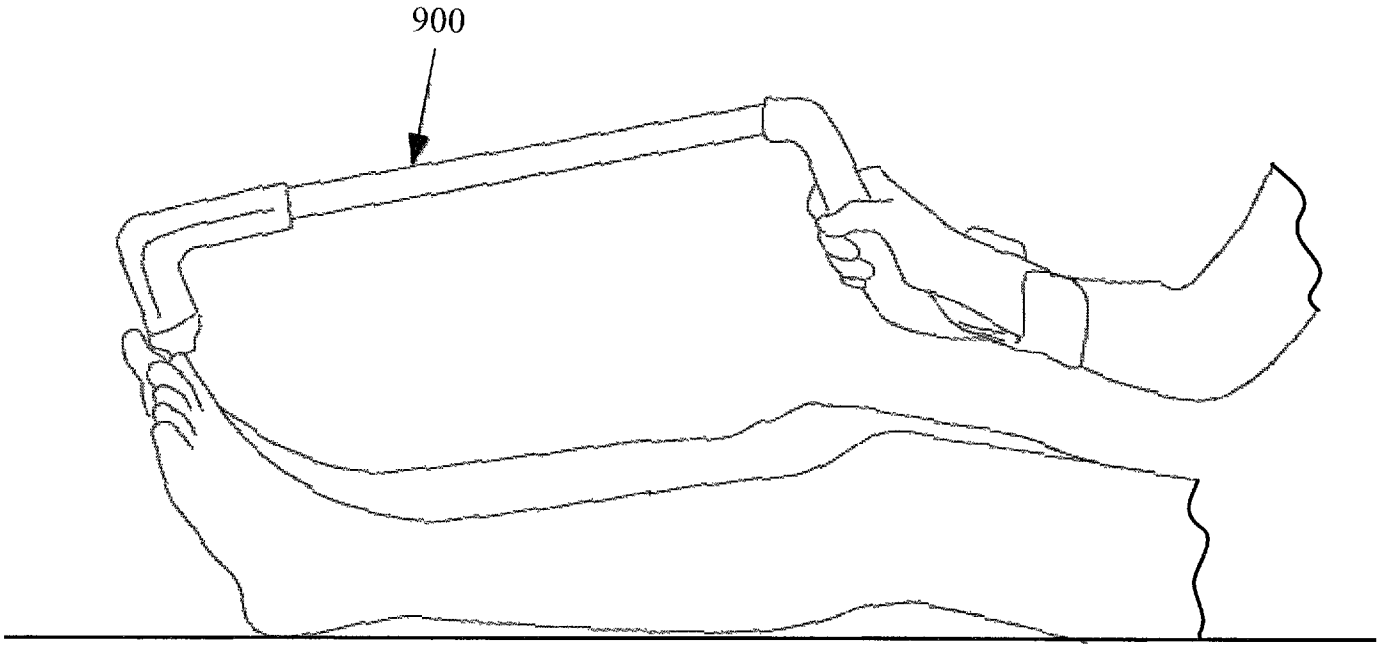
FIG. 45 is the long handled nail groomer of FIG. 44, but is shown being utilized by a person to file his/her toenails while seated on a flat surface, such as a couch, with his/her legs outstretched, and with the weight of the grooming head being borne upon the toenail being filed.

The shaft portion 810 may extend a particular length 810L between its first end 811 and second end 812, as seen in FIG. 23, in order to position the filing bit in proximity to at least one toenail of the user when the handle is grasped and manipulated by the user, permitting filing of the user's toenails when the user is in a seated position. The seated position may be where the user may be seated in a chair or on a toilet seat, as shown in FIG. 24, or where the user is seated on a generally flat surface such as a floor surface or when positioned transversely on a couch, as shown in FIG. 45.

As noted above, the grooming head 830 may be operated by itself to conveniently file fingernails. To utilize the grooming head 830 without the shaft portion 810 being attached thereto, any structural arrangement known in the art may be utilized to accomplish releasable coupling of the shaft portion to the grooming head.

Figure 41:
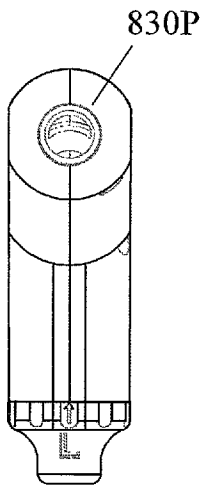
FIG. 41 is a bottom view of the grooming head of FIG. 22.

For example, in one embodiment, the housing of the grooming head 830 may have an opening 830P (see e.g., FIG. 41) that may be particularly shaped to receive a portion of one end of the shaft portion 810 therein (e.g., a cylindrical opening that receives a cylindrical shaft portion, i.e., having a circular cross-section; or an opening formed with a rectangular cross-section, etc.). Any suitable structure known in the art to releasably secure the shaft portion 810 in the opening 830P may be used. For example, in one embodiment, an ordinary friction fit, or a friction clamp may be used (see e.g., U.S. Pat. No. 10,932,821 to Cremer). In another embodiment, a quick-release clamp may be used to releasably secure the shaft portion 810 in the opening 830P (see e.g., U.S. Pat. No. 4,724,692 to Turin). In yet another embodiment, a detent mechanism may be used to releasably secure the shaft portion 810 in the opening 830P (see e.g., U.S. Pat. No. 6,016,594 to Frey). In a different embodiment, a latch may be used to releasably secure the shaft portion 810 in the opening 830P (see e.g., U.S. Pat. No. 4,179,143 to Shy). In a further embodiment, a threaded arrangement may be used to releasably secure the shaft portion 810 in the opening 830P (e.g., external threads on the shaft portion 810 and internal threading in the opening 830P).

Figure 28:
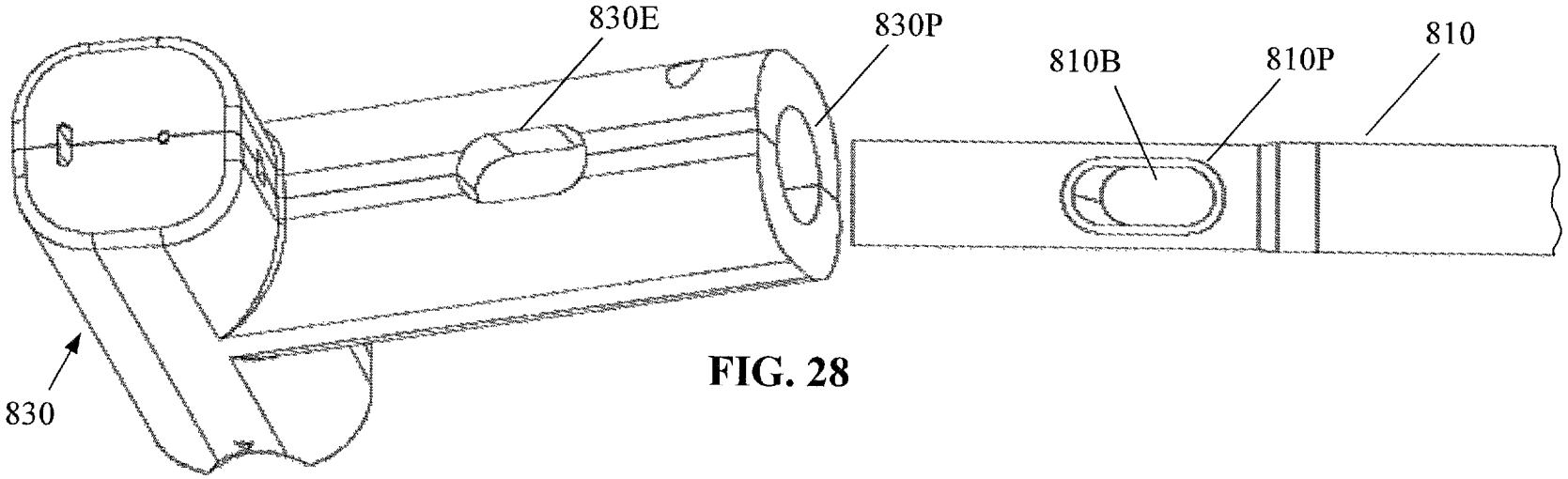
FIG. 28 is a perspective view showing the grooming head and shaft of FIG. 23, shown with the shaft positioned just prior to being releasably coupled to the grooming head.
Figure 29:
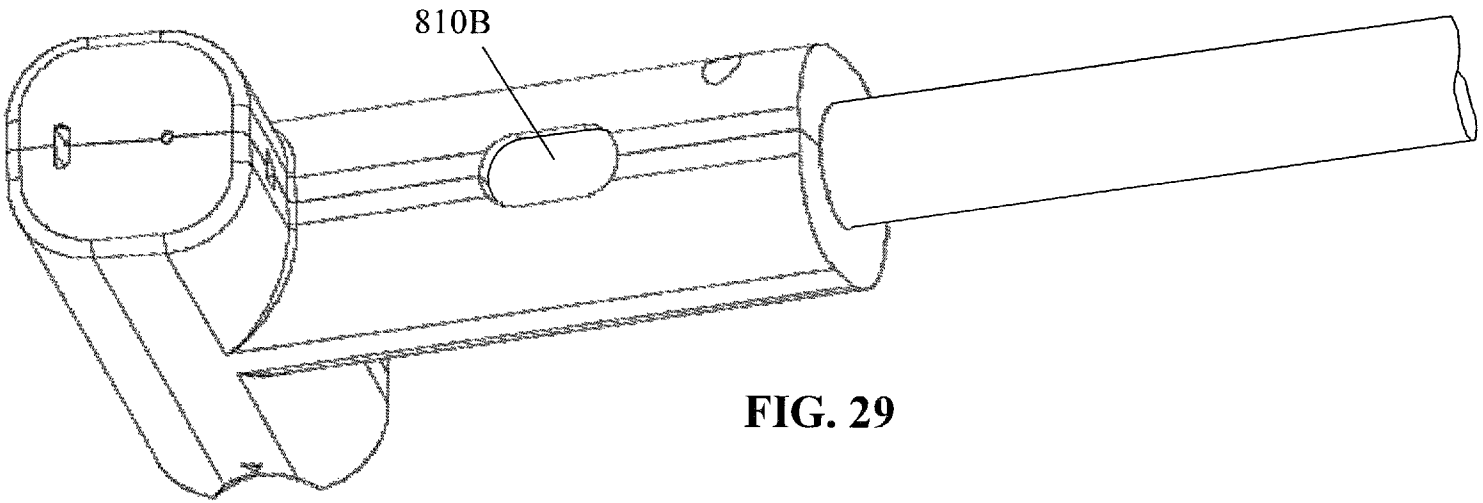
FIG. 29 is the perspective view of FIG. 28, shown after the shaft has been releasably coupled to the grooming head.
Figure 30:
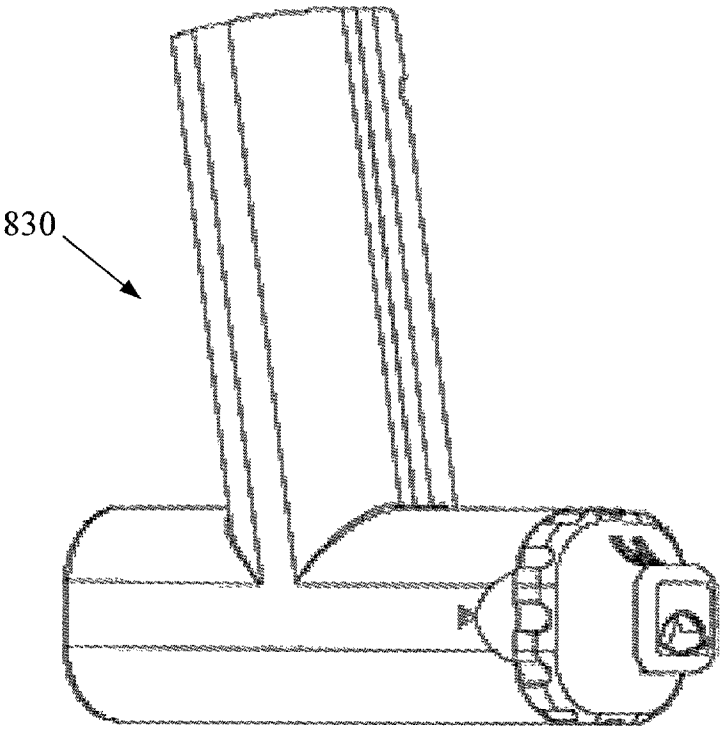
FIG. 30 is a perspective view showing the front of the grooming head of FIG. 23.
Figure 34B:
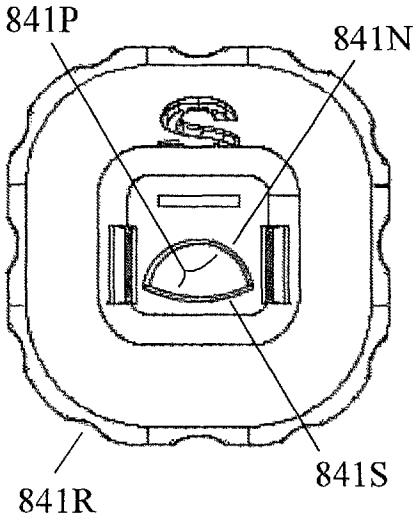
FIG. 34A and FIG. 34B are enlarged side and top views of one of the detachable filing caps shown in FIG. 23, and which has a small size opening.
Figure 35B:
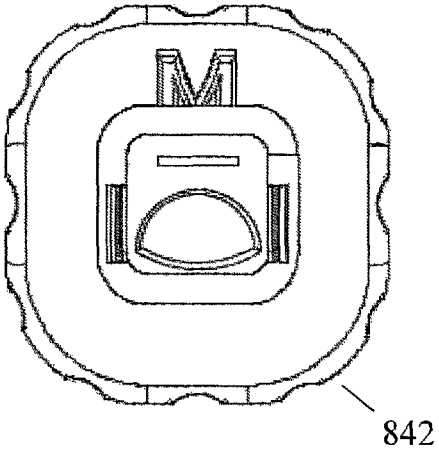
FIG. 35A and FIG. 35B are enlarged side and top views of one of the detachable filing caps shown in FIG. 23, and which has a medium size opening.
Figure 36B:
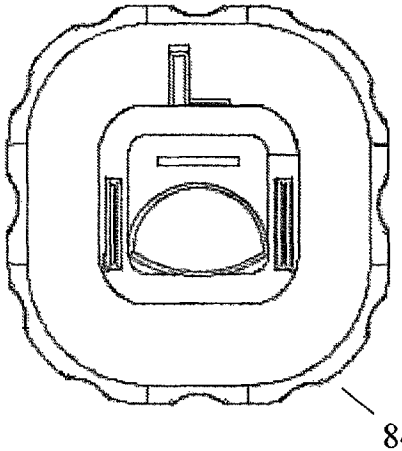
FIG. 36A and FIG. 36B are enlarged side and top views of one of the detachable filing caps shown in FIG. 23, and which has a large size opening.
Figure 37B:
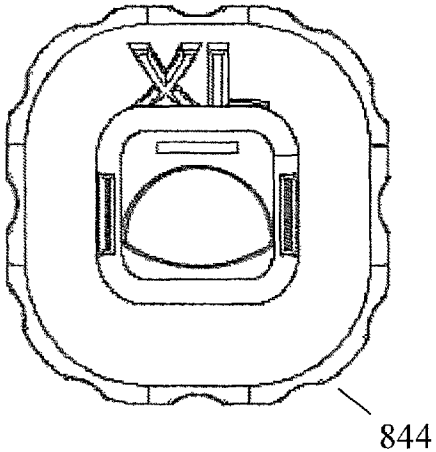
FIG. 37A and FIG. 37B are enlarged side and top views of one of the detachable filing caps shown in FIG. 23, and which has an extra-large size opening.
Figure 34A:
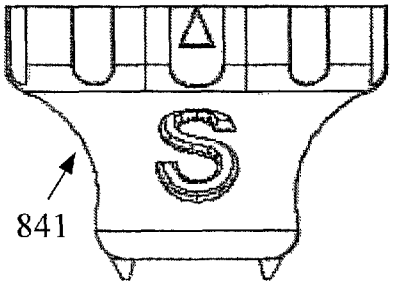
Figure 35A:
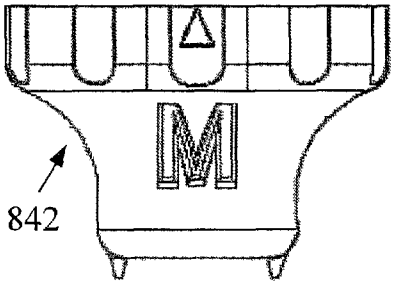
Figure 36A:
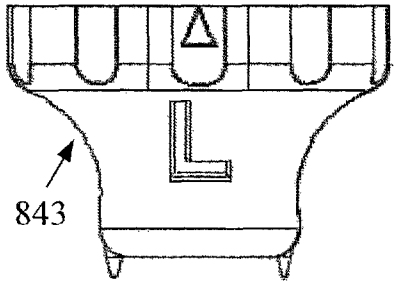
Figure 37A:
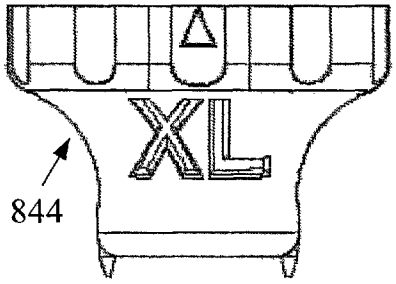
Figure 39C:
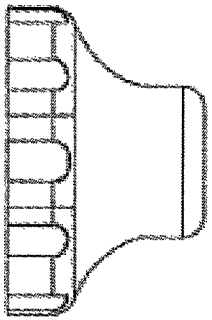
FIGS. 39A, 39B, and 39C are side, top, and end views of the filing cap of FIG. 38.
Figure 39B:
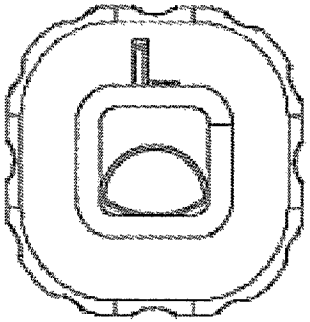
Figure 39A:
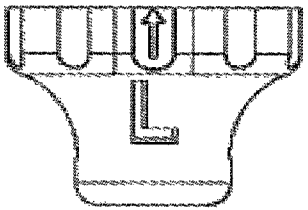
Figure 38:
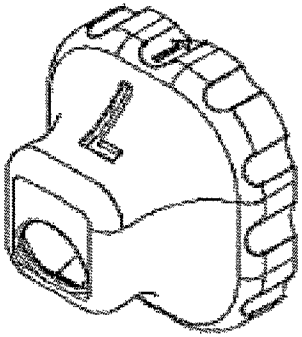
FIG. 38 is a perspective view of another embodiment of a filing cap, being similar to the filing cap of FIGS. 36A-36B.

Another releasable coupling arrangement that may be used is shown in FIG. 28 and FIG. 29. As seen therein, the shaft portion 810 may have an opening 810P defining a recess, which opening may be elongated. The shaft portion 810 may have a correspondingly shaped button 810B that may be slidably disposed in the recess, and which may be biased by a spring 810S (see FIG. 23) from a retracted position into the extended position where a portion of the button protrudes out from the opening 810P, as shown in FIG. 28. In addition to the opening 830P that may define a cylindrical recess in the grooming head 830, another opening 830E may define a recess in the grooming head that may be shaped to correspond to the shape of the button 810B, and which may interconnect with the cylindrical recess created by opening 830P. To releasably couple the shaft portion 810 to the grooming head 830, the button 810B may be depressed, and the end of the shaft portion may be inserted into the opening 830P in the grooming head. Once the depressed button 810B reaches the recess formed by the opening 830E, the button will be biased into its extended position and may thereby extend into that recess, as seen in FIG. 29. To prevent inadvertent decoupling of the grooming head 830 from the shaft portion 810, the button in the extended position shown in FIG. 29 may preferably be disposed slightly below the exterior surface of that region of the housing of the grooming head.

The nail groomer 800 may also permit easy removal and replacement of a portion of the housing. Although in one embodiment the nail groomer 800 may have the filing cap 841 be fixedly secured to the housing (831/832) of the grooming head, in another embodiment the filing cap 841 may alternatively be releasably secured to the housing, and may thereby be interchangeable with other different filing caps (e.g., the filing caps 841, 842, 842, and 844 shown in detail in FIGS. 34A-39C). The interchangeable filing caps permit replacement of one filing cap with another filing cap having a different sized opening (and/or a different shaped opening), for use on a different sized/shaped toenail or fingernail.

The opening in each filing cap (e.g., opening 841P in filing cap 841 shown in FIG. 34B), may be shaped to correspond to the shape of a tip of a finger and/or a toe. Therefore, each opening, such as opening 841P, may be formed with a generously radiused (curved) side 841N, which may be an arc segment, and may correspond to the curved shape of a nail (fingernail or toenail), and a shallower curved side 841S, which may roughly correspond to the skin of the portion of the finger adjacent to the nail, but which shallower curve may be slightly undersized (a larger radius of curvature) so that the skin surface of the tip of the finger may be depressed by the opening, to prevent its contact with the abrasive surface of the filing bit 835 (see e.g., FIG. 27).

Figure 25B:
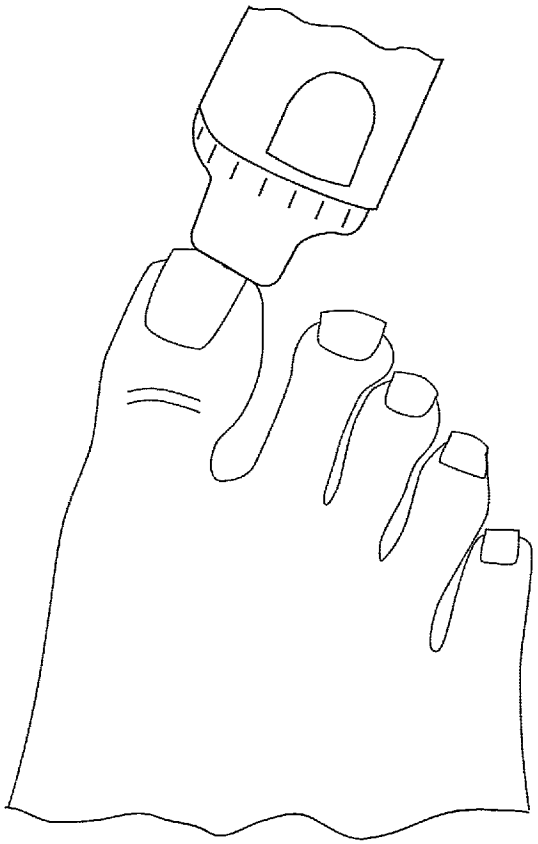
FIG. 25A and FIG. 25B are first and second perspective views showing a person sliding the filing bit of the grooming head of FIG. 23 across different portions of the tip of a toenail to file the nail.
Figure 25A:
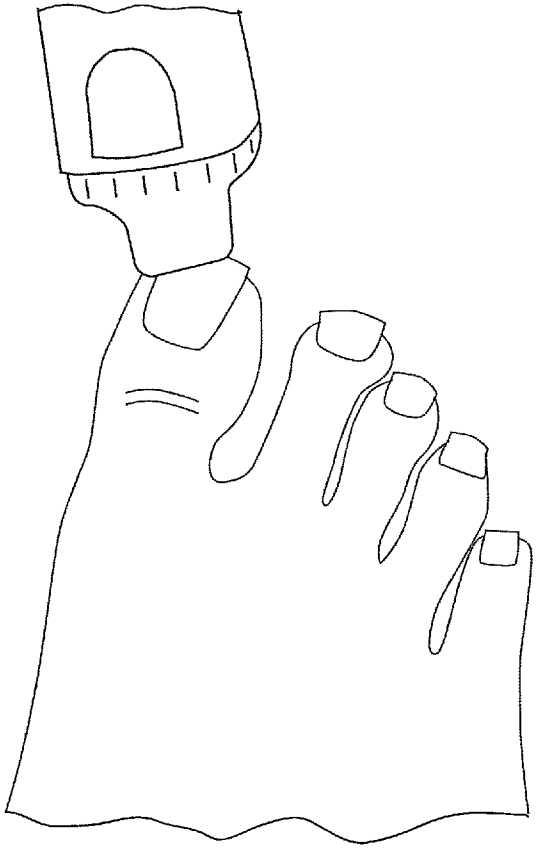
Figure 26:
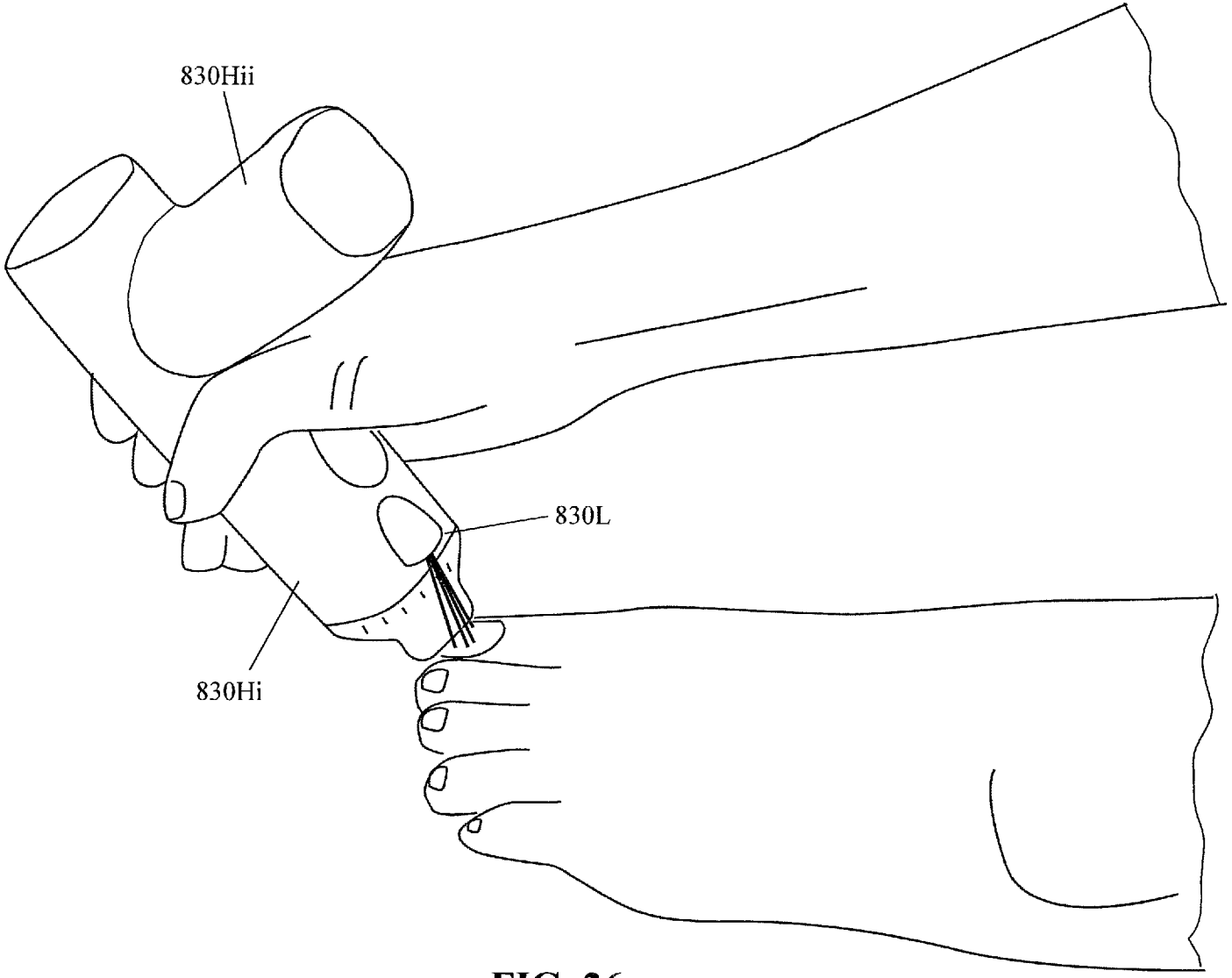
FIG. 26 is a perspective view showing only the grooming head of the long handled nail groomer of FIG. 22, being utilized by a person to file his/her toenails, by grasping of a first portion of the housing of the grooming head.
Figure 27:
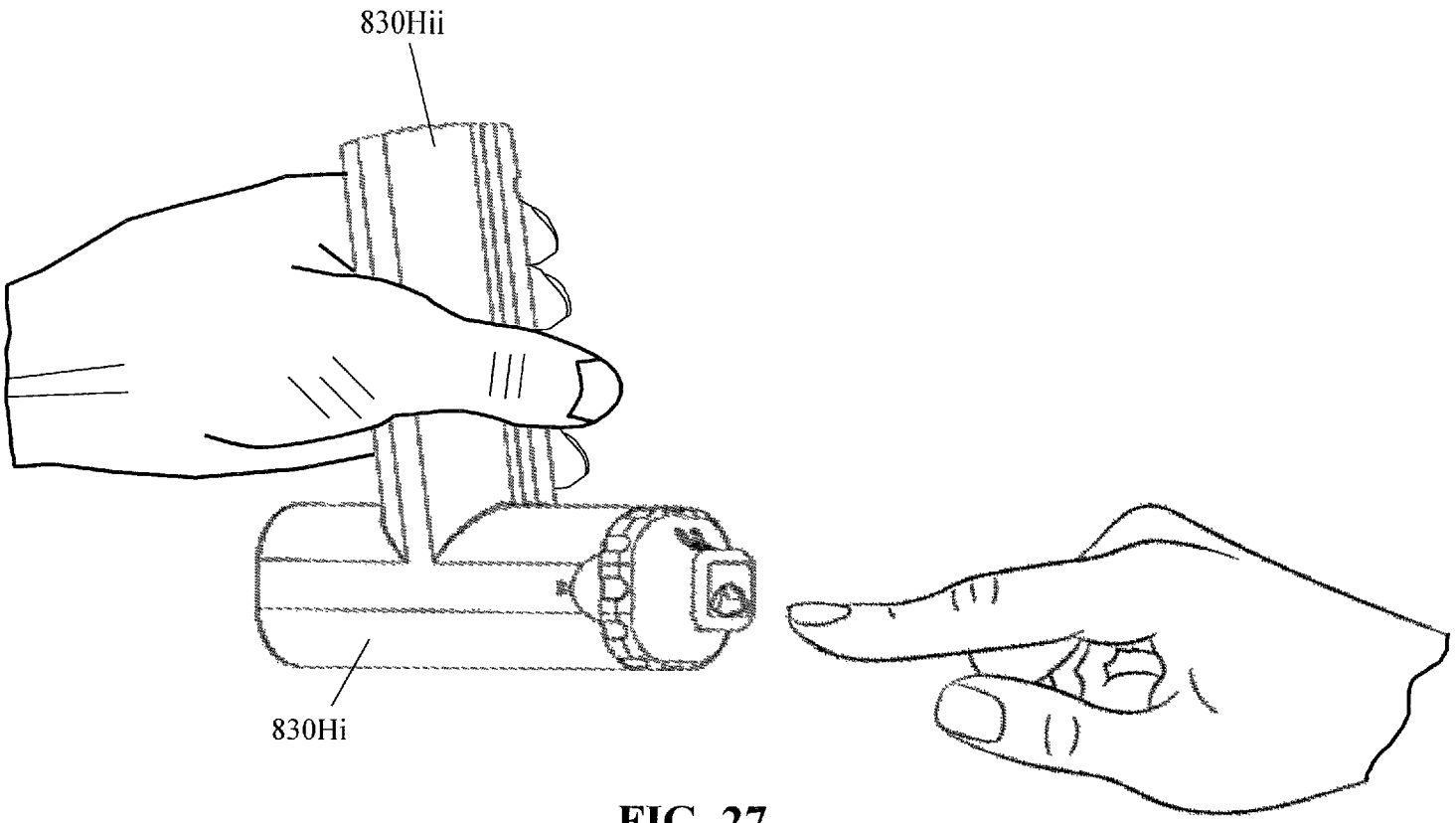
FIG. 27 is a perspective view showing only the grooming head of the long handled nail groomer of FIG. 22 being utilized by a person to file his/her fingernails, by grasping of a second portion of the housing of the grooming head.

Having the availability of multiple different filing caps with different sized openings (e.g., the filing caps 841, 842, 842, and 844) permits the user to operate the nail groomer 800 in a multiple different ways. The user may select and use a filing cap that may have an opening sized to admit the entire tip of the finger or toe (see e.g., FIG. 26). Alternatively, the use may select a filing cap that has an opening that is smaller the entire tip of the finger or toe, in which case the user may slide/rotate the grooming head 830 across the extent of the toenail or fingernail to accomplish filing of the nail, as seen in FIG. 25A and FIG. 25B. It is also noted that the two portions of the housing (i.e., 830Hi and 830Hii) may each be sized and/or shaped to permit grasping of at least one of those portions by the user to effect filing of toenails in a comfortable manner (i.e., grasping the housing portion 830Hi, as seen in FIG. 26), and/or grasping of the other portion by the user to effect filing of fingernails in a comfortable manner (i.e., grasping the housing portion 830Hii, as seen in FIG. 27).

The interchangeable filing caps (e.g., filing caps 841, 842, 843, and 844) may snap on to the housing of the grooming head using a detent arrangement, or may be threadably attached using a standard threaded arrangement, or may twist onto the housing of the grooming head 830 using a one-quarter turn quick-release fastening arrangement (see e.g., U.S. Pat. No. 5,123,795 to Engel; and see also: U.S. Pat. No. 4,213,230 to Hoen; U.S. Pat. No. 6,062,441 to Mengeu; U.S. Pat. No. 6,520,387 to Soehulen; etc.).

Each of the interchangeable filing caps, as seen at least in FIG. 34A-35B, may be formed with an oversized periphery for easier grasping by a hand of an elderly user, to better accommodate its removal and reattachment. The oversized periphery may also be formed to have a series of indentations (e.g., 841R) to create a ribbed periphery to prevent slipping of the elderly user's hand while gripping the filing cap and attempting to affect its removal, as may often occur with the removal of a smooth metal top on a jar of food. For that reason, the oversized periphery may also be formed to have a square shape with rounded corners. Note that use of these interchangeable filing caps may also conveniently accommodate quick removal of collected nail filings.

The handle portion 820 of the nail groomer 800 may include a strap 820S (see FIG. 23) that may be slipped onto the wrist of a user, prior to grasping of the handle portion by the user, as shown in FIG. 24. The strap 820S may prevent the nail groomer 800 from falling to the ground if an elderly user inadvertently loses his/her grip on the handle portion 820.

As seen in FIG. 42, the handle portion 820 may alternatively or additionally be formed to include a transition portion 832 and a generally flat forearm support portion 833, which may rest against (i.e., be in contact with) at least a portion of the forearm of the user when the ergonomic portion of the handle portion is grasped by the user. The forearm support portion 833 may thereby provide a second point of support for the nail groomer 800, as described hereinabove. To be more comfortable against the user's arm, the forearm support portion 833 may extend to be about as long as the forearm of the user, and may therefore be formed to be at least as long as would be needed to extend across the entire forearm of the smallest user (e.g., the forearm length of the $5^{th}$ percentile elderly woman). The forearm support portion 833 may be formed to include padding 833P to be more comfortable against the user's skin/arm. The padding 833P may include, but is not limited to, a foam pad that may be secured to the forearm support portion 833, a rubber pad that may be coated thereon, etc.

The nail groomer 800, as well as any of the other devices disclosed herein, may include a light emitting diode or other light source 830L, as seen in FIG. 26, which may be used to direct light onto, and illuminate, the toenail or fingernail being filed.

The nail groomer 800, as well as any of the other devices disclosed herein, may include a proximity sensor that may be configured to detect when the fling bit comes in close proximity to, or actually contacts, the user's skin. This feature may be important to accommodate diabetics who have foot neuropathy, and who want to use this device but cannot feel his/her foot.

Figure 44:
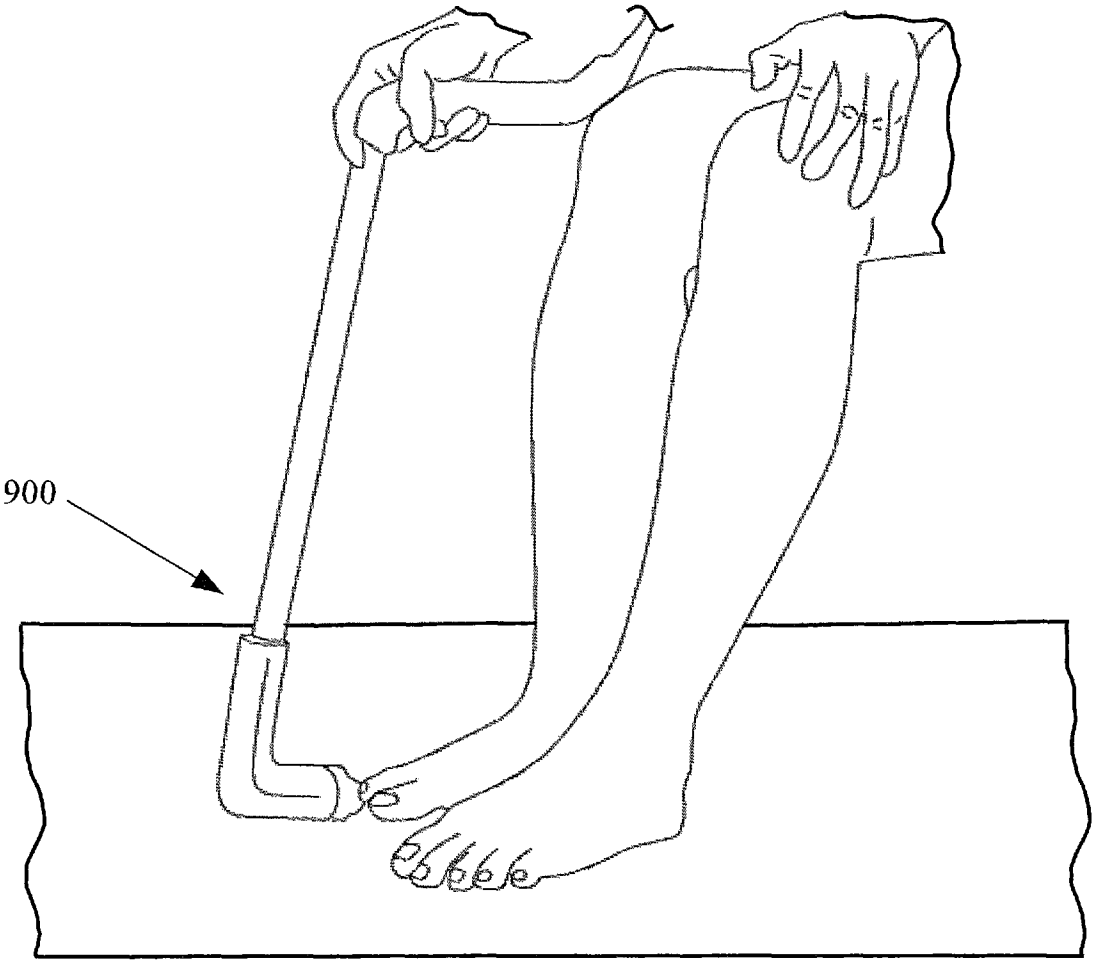
FIG. 44 is a perspective view of another long handled nail groomer, shown being utilized by a person to file his/her toenails while seated in a chair.

A nail groomer 900 is shown in FIGS. 44-45, which may be formed substantially the same as the nail groomer 800, and which may also include a cuff 917 that may be formed as part of the forearm support portion. FIG. 44 illustrates that the user may utilize the device with a portion of the handle resting on his/her knee, and/or with a portion of the grooming head resting on a floor surface, so the user does not need to support the weight of the device.

Each of the nail groomers 800 and 900 may be formed, as seen at least in FIG. 24 and FIG. 44, respectively, such that an axis of the filing bit is slightly less than perpendicular to an axis of the shaft, being about an angle of between 75 degrees to 90 degrees, and more preferably at an angle of about 80 degrees to 85 degrees (see also, FIG. 40 and FIG. 23). As such, the flat surface of the filing bit may be positioned nearly perpendicular to the toenail to be filed, and at least a portion of the weight of the nail groomer (e.g., the weight of the grooming head) may thereby apply a force between the flat surface of the filing bit and the toenail, to abrade the toenail without requiring the user to apply a force using his/her arm. As may be seen in FIG. 45, the nail groomer 900 may be formed at a 90 degree angle to provide for ergonomic filing of nails as illustrated therein.

A nail groomer 1000 is shown in FIGS. 44-45, which may be formed substantially the same as the nail groomer 800, but which may not utilize a filing cap. Also, the nail groomer 1000 may be configured to have an axis 1035X of the filing bit 1035 oriented at an obtuse angle Θ with respect to an axis 1010X of the shaft 1010. The obtuse angle Θ may be roughly between 130 degrees and 140 degrees. In addition, the nail groomer 1000 may be configured to have a grooming head 1030 with a particularly shaped housing 1030H. The housing 1030H may have a first housing portion 1030Hi and a second housing portion 1030Hii, where the first housing portion has a first shaped exterior surface, the second housing portion has a second shaped exterior surface, and the housing may have a transition section 1030T between the first and second housing portions. The shaft may be mounted to the first housing portion 1030Hi. Together, those housing portions may form a housing that may also resemble the grip of an old-style pistol.

Figure 46:
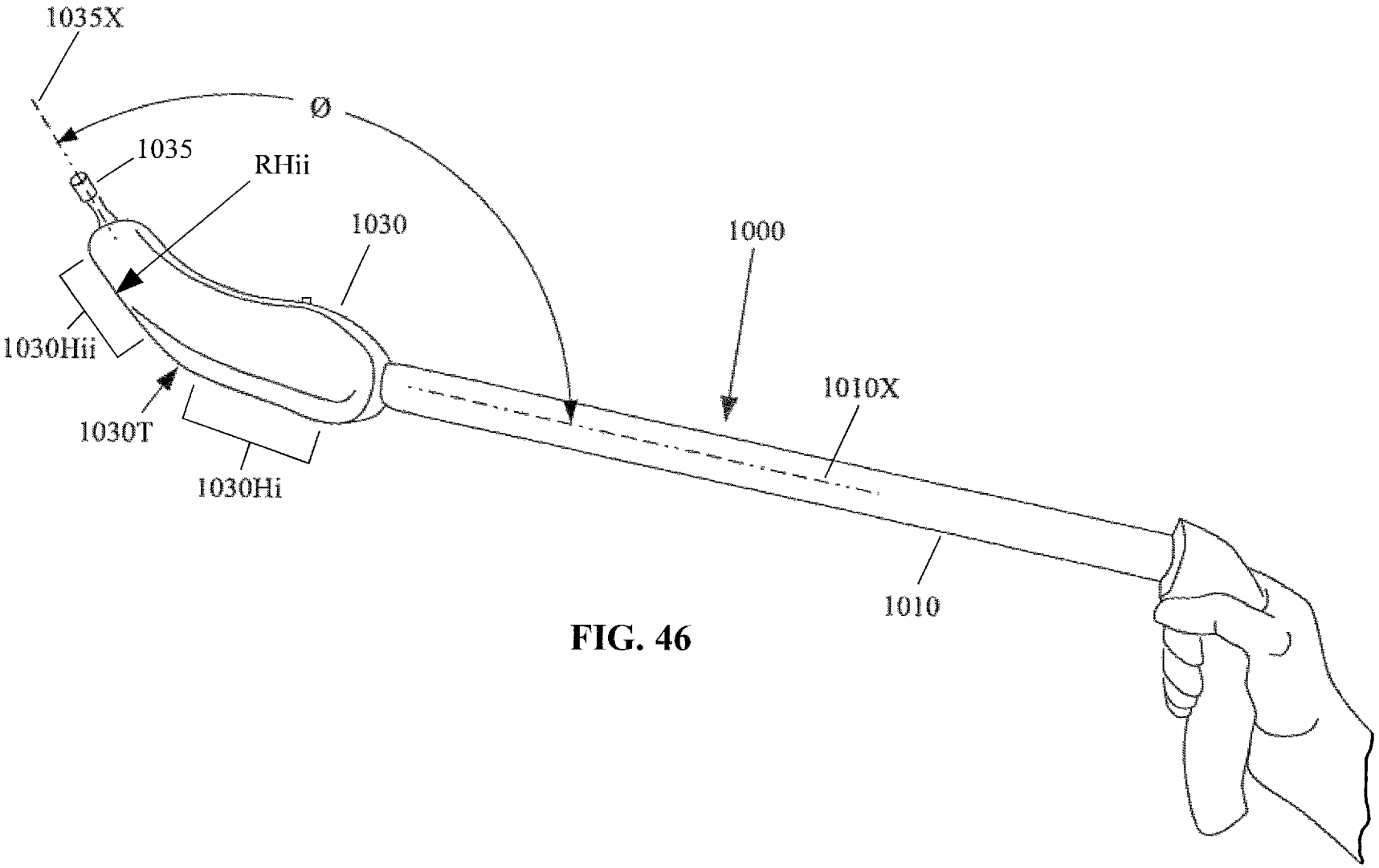
FIG. 46 is a perspective view of yet another long handled nail groomer, having a particularly shaped housing with a portion thereof configured to rest upon the top of the foot of the user, when being utilized by a person to file his/her toenails while seated.
Figure 48:
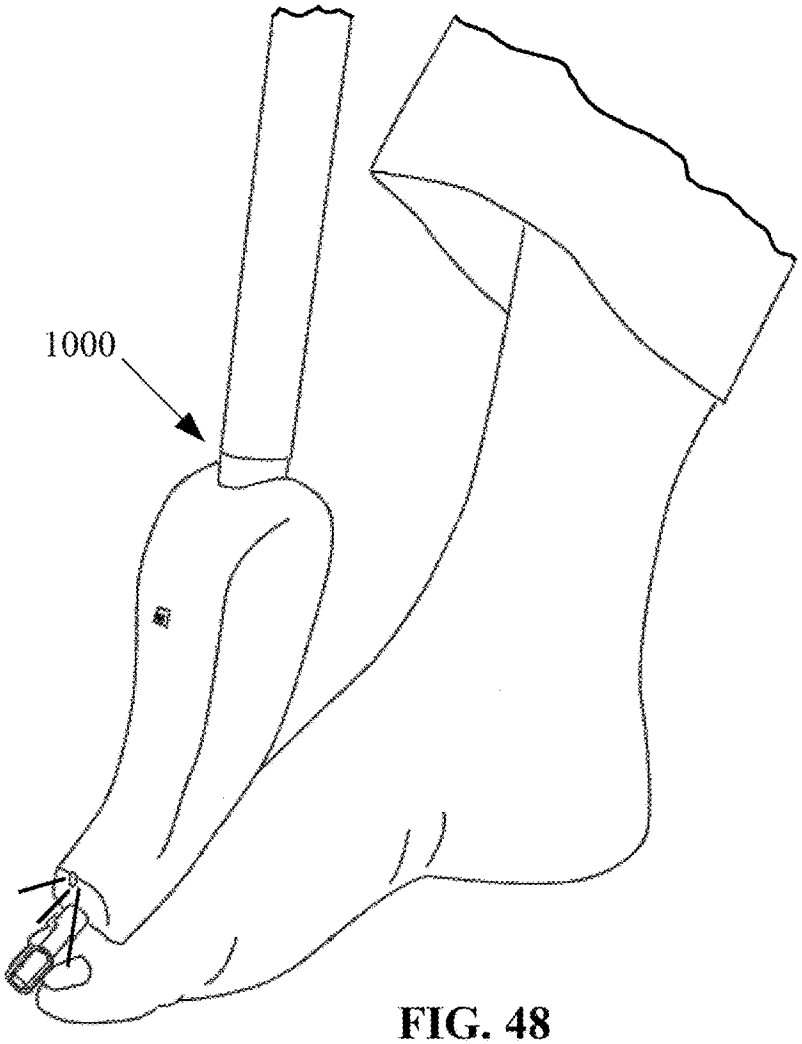
FIG. 48 is the perspective view of FIG. 47, but is shown after the light of the long handled nail groomer has been turned on to illuminate the toenail being filed.
Figure 47:
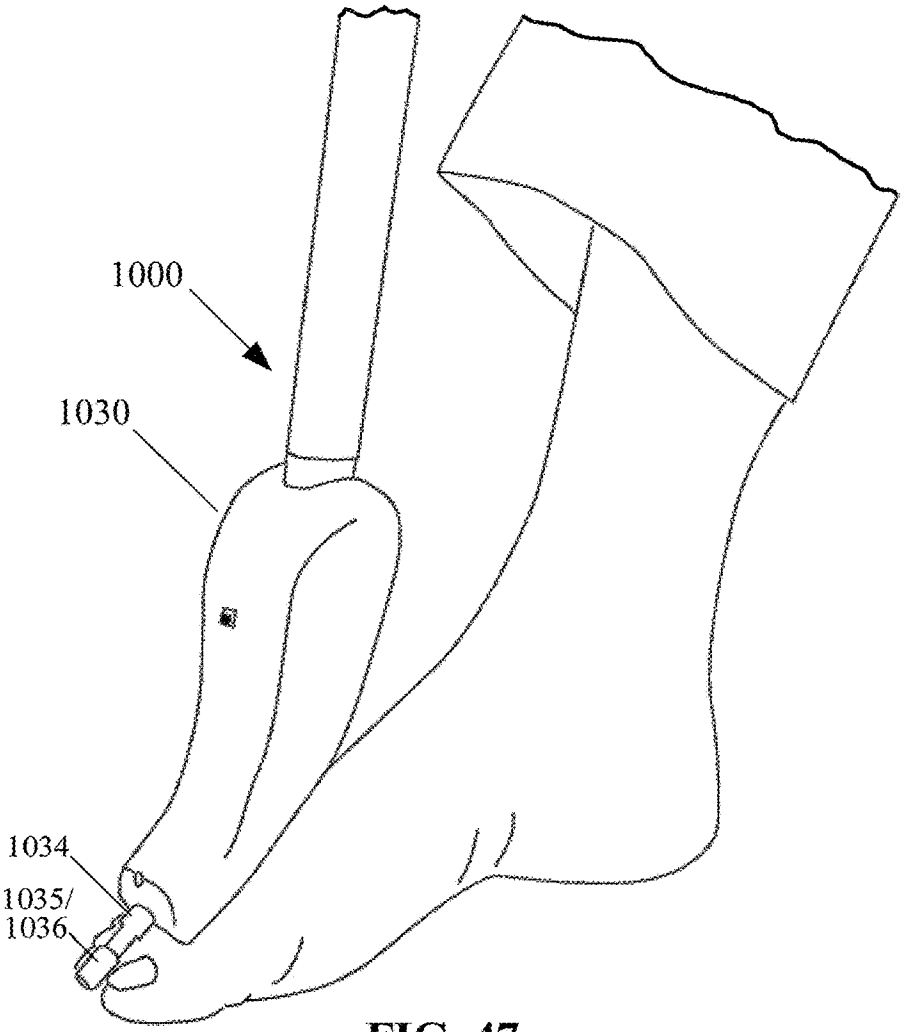
FIG. 47 is a perspective view of the long handled nail groomer of FIG. 46, being used to file the toenails of a user, with a portion of the housing resting on the top of the user's foot.
Figure 49:
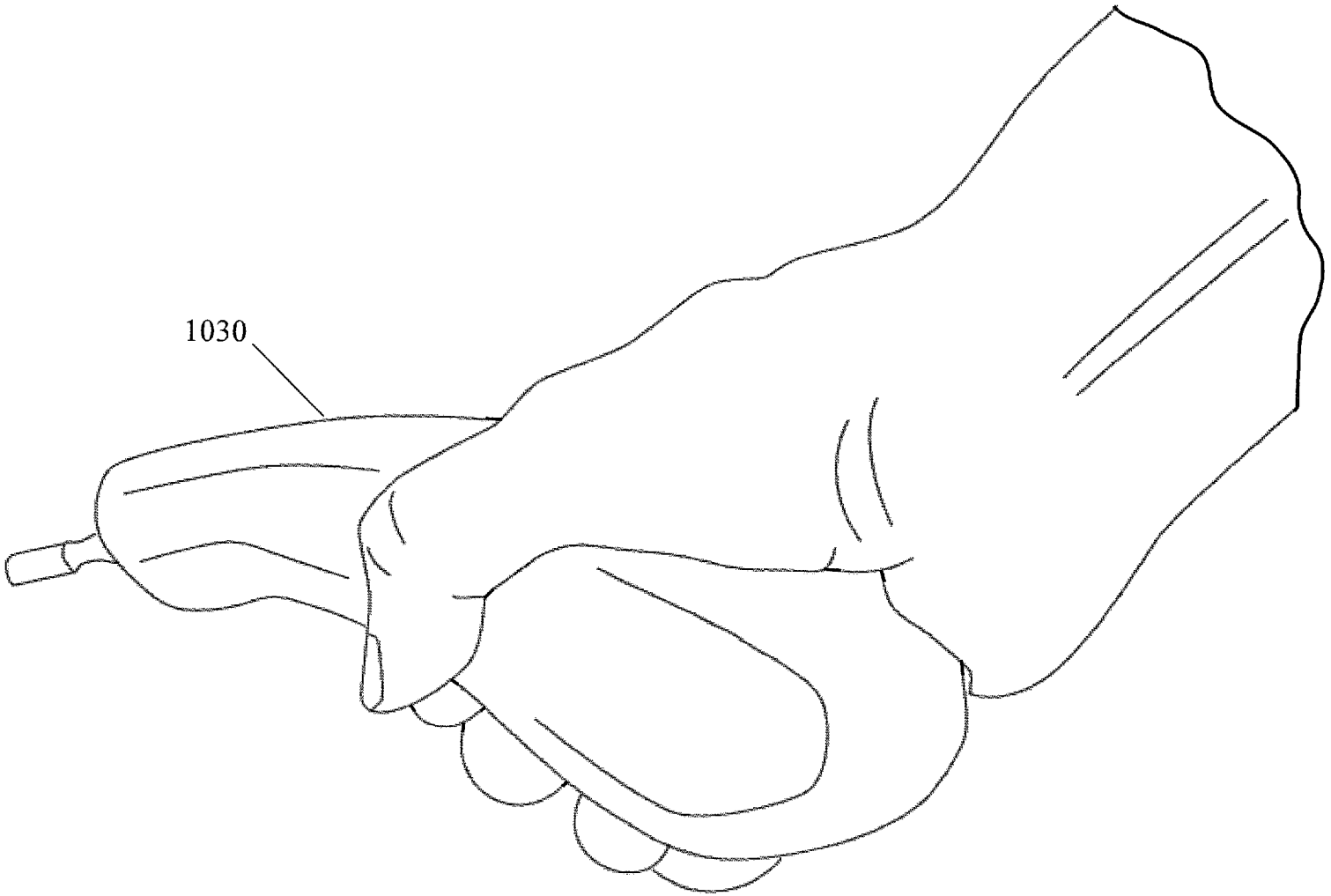
FIG. 49 is a perspective view of the grooming head of the long-handled nail groomer of FIG. 46, shown after it has been decoupled from the shaft, and is being held in the hand of a user.

As may be seen in FIG. 47, the second shaped exterior surface on the second housing portion 1030Hii may be formed with an ergonomic shape configured to correspond to and rest upon a top of the foot of the user, and which may result in a portion of the abrasive surface of the filing bit being positioned in proximity to the user's toenail, when the handle is grasped by the user for filing of his/her toenails. As seen in FIG. 46, the ergonomic shape of the second shaped exterior surface on the second housing portion 1030Hii may be slightly curved, i.e., having a very large radius of curvature, e.g., being a radius RHii of between about 254 mm (10 inches) and 1905 mm (75 inches) in one embodiment. Order radii may be used in other embodiments. The exterior surface of the first housing portion 1030Hi may be shaped so that it remains clear of the user's leg, and may also be shaped so it can be ergonomically grasped by the user when held by itself for filing of fingernails, as indicated in FIG. 49. Being formed as such, the obtuse angle between the axis of the filing bit and the axis of the shaft may position the axis 1035X of the filing bit 1035 at an acute angle with respect to a tip of the toenail being filed, as seen in FIG. 47.

Figure 51:
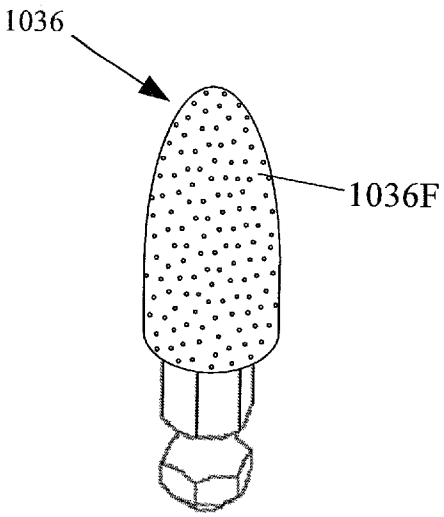
FIG. 51 is a perspective view of a cone shaped filing bit that is usable with the nail groomer of FIG. 46.
Figure 50:
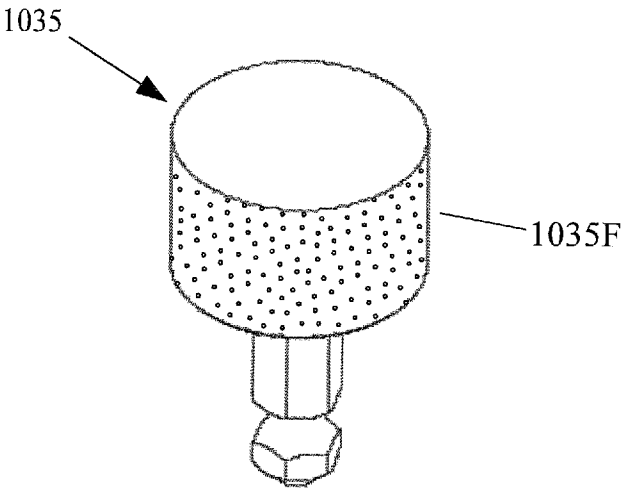
FIG. 50 is a perspective view of a cylindrical shaped filing bit that is usable with the nail groomer of FIG. 46.

Different filing bits may preferably be used with the grooming head 1030 of the nail groomer 1000, and therefore a releasable coupling arrangement 1034 for coupling of the filing bit to the motor may be preferred. As may be seen in FIG. 50, a first filing bit 1035 may be formed to have a cylindrical shape that may include a generally cylindrical abrasive surface 1035F. Also, a filing bit 1036, as seen in FIG. 51, may instead be formed to have an abrasive surface 1036F that may be generally cone-shaped, to permit filing of a custom contour on the tip of the user's nails (e.g., being sloped towards the ends).

While illustrative implementations of one or more embodiments of the disclosed nail groomer are provided hereinabove, those skilled in the art and having the benefit of the present disclosure will appreciate that further embodiments may be implemented with various changes within the scope of the disclosed nail groomer. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A toenail groomer comprising:

a shaft, said shaft having a first end and a second end, and comprising: a length;

a handle; said handle being oriented at an angle to said shaft and configured to be grasped by a hand of a user to manipulate said toenail groomer;

a grooming head, said grooming head comprising:

a housing, said housing comprising: a first portion and a second portion; said first portion comprising: a first shaped exterior surface; and said second portion comprising: a second shaped exterior surface; wherein said shaft is mounted to said first portion of said housing;

a motor, said motor mounted to said housing;

a filing bit, said filing bit comprising an abrasive surface;

wherein a mounting portion of said motor is configured to couple to a portion of said filing bit, said motor thereby configured to rotate said filing bit;

wherein said abrasive surface of said filing bit protrudes from said second portion of said housing; and wherein an axis of said filing bit is oriented at an obtuse angle with respect to an axis of said shaft;

wherein said second shaped exterior surface of said second portion of said housing comprises: a contoured shape configured to sit on a top of a foot of the user;

wherein said length of said shaft is configured to position said contoured shape of said second portion of said housing of said grooming head on the top surface of the foot of the user to thereby support the weight of said toenail groomer, when said handle is grasped and manipulated by the user; and wherein said handle, said length of said shaft, and said mounting portion of said motor are configured to position at least a portion of said abrasive surface of said filing bit in proximity to at least one toenail of the user, when said handle is grasped and manipulated by the user, to permit filing of the at least one toenail.

2. The toenail groomer according to claim 1, wherein said handle, said length of said shaft, and said mounting portion of said motor are configured to support said filing bit to extend in a direction facing away from the user, with at least a portion of said abrasive surface of said filing bit being thereby positioned in proximity to the at least one toenail of the user, when said handle is grasped and manipulated by the user when the user is at least seated and sitting upright.

3. The toenail groomer according to claim 2, wherein said obtuse angle between the axis of said filing bit and the axis of said shaft positions the axis of said filing bit at an acute angle with respect to a tip of the at least one toenail.

4. The toenail groomer according to claim 1, wherein said a handle is fixedly secured to said shaft.

5. The toenail groomer according to claim 1, wherein said handle and said shaft are integrally formed as a single unitary part.

6. The toenail groomer according to claim 1, wherein said toenail groomer is configured to be powered by one or more rechargeable batteries; and wherein said toenail groomer comprises: a USB recharging socket.

7. A toenail groomer comprising:

a shaft, said shaft comprising: a length;

a handle; said handle configured to be grasped by a hand of a user to manipulate said toenail groomer;

a grooming head, said grooming head comprising:

a housing, said housing comprising: a curved shaped exterior surface being contoured to sit on a top of a portion of a foot of the user;

wherein said shaft is mounted with respect to a portion of said housing; and a motor and a coupler, said coupler being configured to releasably couple a portion of a filing bit to said motor, and said motor being configured to rotate the coupler and thereby rotate the filing bit to abrade a portion of the toenail;

wherein an axis of said coupler is at an obtuse angle with respect to an axis of said shaft; and wherein said length of said shaft is configured to position said curved shaped exterior surface of said housing of said grooming head on the top surface of the foot of the user to thereby support a weight of said toenail groomer, and to thereby position said coupler to support the filing bit in proximity to at least one toenail of the user, when said handle is grasped and manipulated by the user, to permit filing of the at least one toenail.

8. The toenail groomer according to claim 7, wherein said obtuse angle between the axis of said coupler and the axis of said shaft positions the axis of said coupler at an acute angle with respect to a tip of the at least one toenail, and thereby positions the filing bit at an acute angle with respect to the tip of the at least one toenail.

9. The toenail groomer according to claim 7, wherein said a handle is fixedly secured to said shaft.

10. The toenail groomer according to claim 7, wherein said handle and said shaft are integrally formed as a single unitary part.

11. The toenail groomer according to claim 7, wherein said toenail groomer is configured to be powered by one or more rechargeable batteries; and wherein said toenail groomer comprises: a USB recharging socket.

12. A nail groomer comprising:

a shaft, said shaft having a first end and a second end, and comprising: a length;

a grooming head, said grooming head comprising:

a housing, said housing comprising: a contoured exterior surface configured to rest on a top surface of a foot of a user;

wherein said first end of said shaft is mounted with respect to a portion of said housing; and a motor and a coupler, said coupler being configured to releasably couple a portion of a filing bit to said motor, and said motor being configured to rotate the coupler and thereby rotate the filing bit to abrade a portion of the toenail;

a handle, said handle positioned proximate to said second end of said shaft, said handle configured to be grasped by a hand of the user to manipulate said toenail groomer, said handle being an at angle to said shaft; and wherein said length of said shaft is configured to position said contoured exterior surface of said housing of said grooming head on the top surface of the foot of the user to thereby support a weight of said toenail groomer, and to thereby position said coupler to support the filing bit in proximity to at least one toenail of the user, when said handle is grasped and manipulated by the user, to permit filing of the at least one toenail.

13. The nail groomer according to claim 12, wherein said obtuse angle between an axis of said coupler and an axis of said shaft positions the axis of said coupler at an acute angle with respect to a tip of the at least one toenail, and thereby positions the filing bit at an acute angle with respect to the tip of the at least one toenail.

14. The nail groomer according to claim 13, wherein said handle, said length of said shaft, and said motor and coupler are configured to support said filing bit to extend in a direction facing away from the user, with at least a portion of an abrasive surface of said filing bit being thereby positioned in proximity to the at least one toenail of the user, when said handle is grasped and manipulated by the user, when the user is positioned upright.

15. The nail groomer according to claim 12, wherein said handle is fixedly secured to said shaft.

16. The nail groomer according to claim 12,
wherein said handle and said shaft are integrally formed as a single unitary part.

17. The nail groomer according to claim 12,
wherein said toenail groomer is configured to be powered by one or more rechargeable batteries; and
wherein said toenail groomer comprises: a USB recharging socket.

* * * * *